US008104499B2

(12) United States Patent
Rashid

(10) Patent No.: US 8,104,499 B2
(45) Date of Patent: Jan. 31, 2012

(54) PRECISION SIPHON OPERATED SEPTIC FIELD DOSING SYSTEM WITH FILTRATION AND BACKWASH

(76) Inventor: Abdul Rashid, Poughquag, NY (US)

( * ) Notice: Subject to any disclaimer, the term of this patent is extended or adjusted under 35 U.S.C. 154(b) by 976 days.

(21) Appl. No.: 12/079,858

(22) Filed: Mar. 28, 2008

(65) Prior Publication Data

US 2008/0178943 A1 Jul. 31, 2008

Related U.S. Application Data

(63) Continuation-in-part of application No. 11/699,151, filed on Jan. 29, 2007, now abandoned.

(51) Int. Cl.
*F04F 10/00* (2006.01)
*F16L 43/00* (2006.01)

(52) U.S. Cl. ..... 137/135; 137/132; 137/143

(58) Field of Classification Search ..... 137/123, 137/132, 135, 142, 143, 240, 557, 558, 386, 137/101.27, 101.25, 236.1; 222/416, 53; 210/108

See application file for complete search history.

(56) References Cited

U.S. PATENT DOCUMENTS

| | | | | |
|---|---|---|---|---|
| 337,227 | A * | 3/1886 | Barden | 159/44 |
| 736,504 | A * | 8/1903 | Dixon | 137/135 |
| 1,600,306 | A * | 9/1926 | Beddoes et al. | 137/127 |
| 3,202,174 | A * | 8/1965 | Rudelick | 137/432 |
| 4,040,962 | A | 8/1977 | Hanford | |
| 4,439,323 | A * | 3/1984 | Ball | 210/608 |
| 4,748,999 | A * | 6/1988 | Delwiche | 137/172 |
| 4,838,731 | A | 6/1989 | Gavin | |
| 5,198,113 | A | 3/1993 | Daniels | |
| 5,207,896 | A | 5/1993 | Graves | |
| 5,290,434 | A | 3/1994 | Richard | |
| 5,492,635 | A | 2/1996 | Ball | |
| 5,690,824 | A | 11/1997 | Stuth | |
| 6,027,639 | A * | 2/2000 | Lenhart et al. | 210/108 |
| 6,231,764 | B1 | 5/2001 | Wilkins | |
| 6,886,588 | B2 * | 5/2005 | Malenfant et al. | 137/399 |
| 2003/0057152 | A1 * | 3/2003 | Haridas | 210/603 |
| 2005/0121078 | A1 * | 6/2005 | Hebert et al. | 137/397 |

* cited by examiner

*Primary Examiner* — John Rivell
*Assistant Examiner* — Hailey K Do
(74) *Attorney, Agent, or Firm* — Saile Ackerman LLC; Stephen B. Ackerman

(57) ABSTRACT

A septic field dosing system is described which utilizes a self starting true siphon to deliver a dose of septic tank effluent into a conventional septic field. The precision siphon unit not only eliminates the need for electrical services to the septic tank, thereby eliminating the need for pumps and solenoid operated valves and switches at the septic tank, but also contains the effluent handling equipment in a small unit. For example, the drawdown of the septic tank is used to entirely control the operation of the dosing siphon. Further, the dimensional configuration of the precision siphon operates within the boundaries of the draw down to deliver a proper size dose to the septic field. While a typical septic tank can hold of the order of a thousand or more gallons, the precision siphon can easily fit into a five gallon bucket.

12 Claims, 27 Drawing Sheets

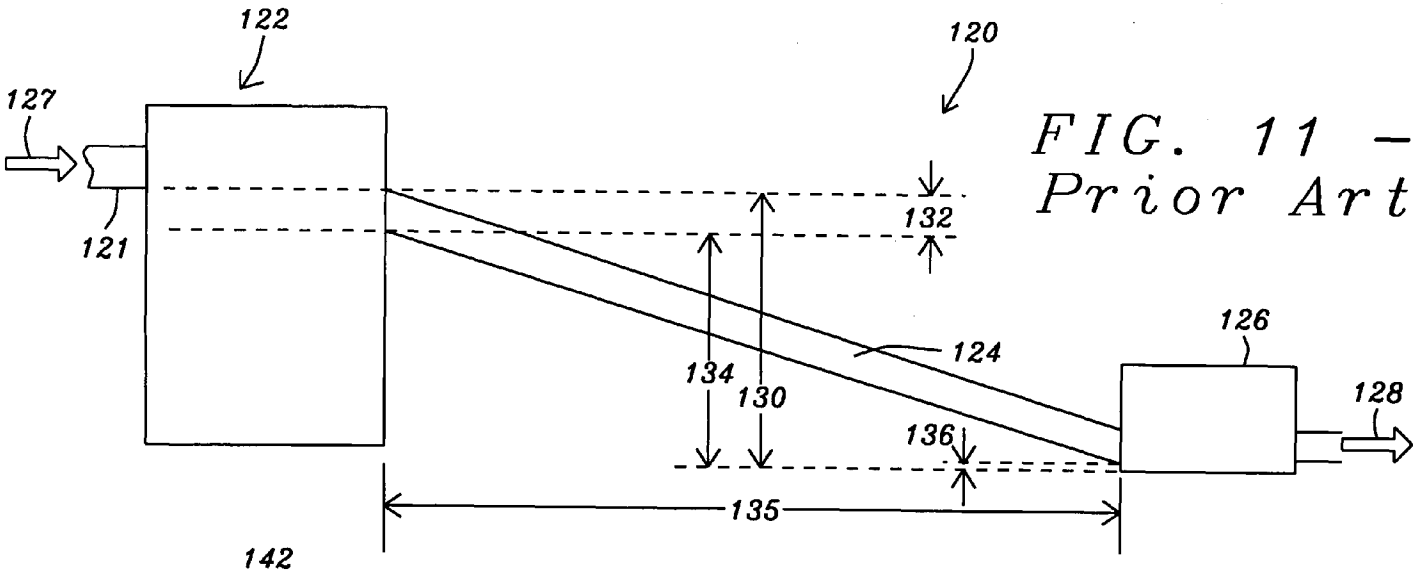
FIG. 11 – Prior Art
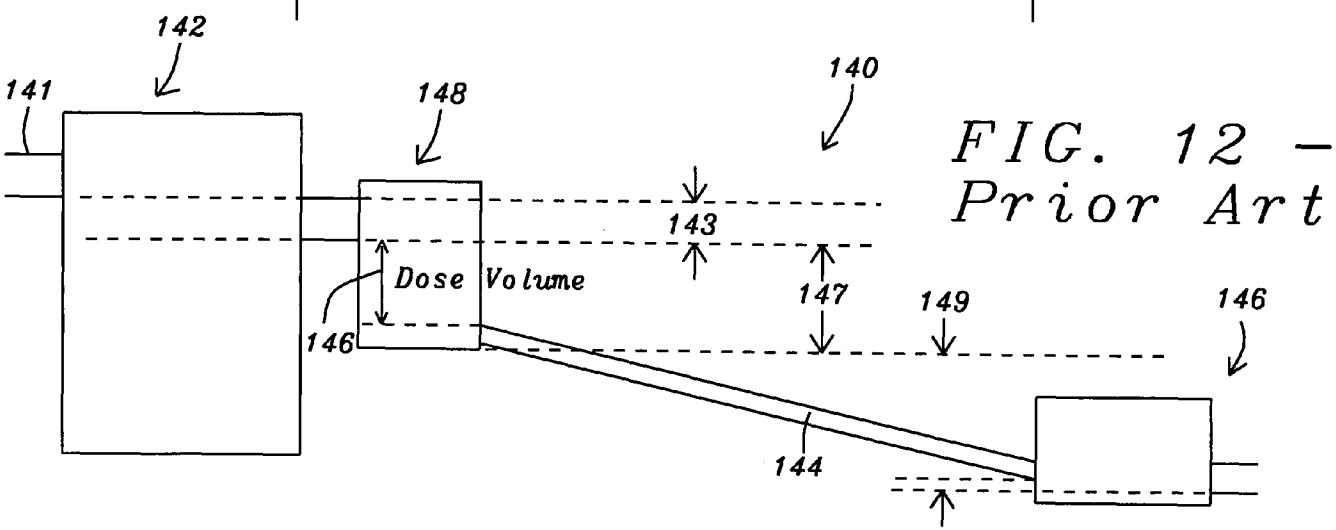
FIG. 12 – Prior Art

PRECISION SIPHON OPERATED SEPTIC FIELD DOSING SYSTEM WITH FILTRATION AND BACKWASH

This is a Continuation-in-Part application of Ser. No. 11/699,151, filed on Jan. 29, 2007 now abandoned, which is herein incorporated by reference in its entirety.

BACKGROUND OF THE INVENTION (1) Field of the Invention

The invention relates to the treatment of wastewater and more particularly, to a septic system design with true siphon dosing and effluent filtration with backwash.

(2) Background of the Invention and Description of Previous Art

It is common knowledge among sanitary engineers that to prolong the life of septic fields it is necessary to clean or filter the effluent from the septic tank and to rapidly discharge a measured quantity (dose) of filtered effluent to flood the septic fields. The dose volume is normally about 70% of the septic field volume. This procedure extends the life of the septic field by distributing the effluent, and more importantly, the residual solids contained in the effluent, over the entire field rather than only near the entrance to the field where they will accumulate and eventually clog the first few feet of the septic field thus rendering a portion of the field's capacity to percolate effluent useless. Once this deterioration starts it will overload the remaining functioning portion of the field, which will lead to a total failure of the field in due time. The replacement of a failed septic system is very costly and messy operation.

Before describing the prior state of the art in this field it would be useful to keep in mind that septic tanks are buried underground to prevent freezing or for esthetic reasons. There is, in general, six inches to a foot or two of earth on top of the tank. To remove the tank covers for pumping out the tank contents or to inspect for malfunctioning components of the system, earth over the tank covers must be dug out to gain access. Access to the septic tank is not easy and is generally beyond the aptitude of most building owners. Typically a functioning septic tank should be pumped out once every two or three years.

The following patents were examined to ascertain the prior state of the art in this field.

| | |
|---|---|
| Hanford, William E., | U.S. Pat. No. 4,040,962 |
| Ball, Harold L., | U.S. Pat. No. 4,439,323 |
| Gavin, Norman, | U.S. Pat. No. 4,838,731 |
| Daniels, Byron C., | U.S. Pat. No. 5,198,113 |
| Graves, Jan D., | U.S. Pat. No. 5,207,896 |
| Richard, James G., | U.S. Pat. No. 5,290,434 |
| Ball, Eric S., | U.S. Pat. No. 5,492,635 |
| Stuth, William L., | U.S. Pat. No. 5,690,824 |
| Wilkins, Charles A., | U.S. Pat. No. 6,231,764 |

Methods and apparatus for improving the performance of septic system as described in the above mentioned patents have found limited use due to one or more of the following drawbacks.

1. High initial investment.
2. Cannot be retrofitted in existing installations.
3. Costly maintenance and operation.
4. Complexity and bulk.
5. High elevation differential requirements.
6. Not true siphons.

7. No dosing provision.
8. Insufficient or no filtration.
9. No provision to indicate the need for backwash or filter replacement.
10. Need for external power (electric pumps).
11. Need for frequent refill of chemicals.
12. Not intended for Septic Systems.

It is important to recognize the enormity of the job a residential septic system must perform over its intended life time which is typically between 20 or more years. A typical single family consumes approximately 1000 gallons of water every day. Over a 25 year period the septic system processes over 9 million gallons or 76 million pounds of effluent. The quality of domestic waste dumped into the septic system varies greatly with the lifestyle of each family, particularly if a food disposal unit is utilized to grind kitchen waste and send it to the septic tank. The amount of sludge and flotsam removed by frequent tank pump outs will also vary over a wide range.

The suspended solids are of most concern because they clog up the septic fields. Daniels, '113 utilizes open cell polymeric foam to filter the effluent from the septic tank. No information is provided regarding the particle size of the solids, which will pass through the filter medium. However it is easy to guess from the general description that the particle size will be fairly small. Although the filter will remove most of the suspended solids from the effluent, frequent replacement of the filter element is necessary. This requires shoveling away the earth to expose the cover, removing the cover and replacing the filter, replacing the cover and the earth, not a welcome task with the ground frozen solid in winter. The reference also requires an electric pump to move the filtered effluent from the dosing chamber to the septic septic fields, thereby requiring the provision of electric service at the tank.

Ball, '635 describes a series of multiple size filters the smallest of which has an opening of $\frac{1}{8}^{th}$ of an inch. Here too an electric pump is required, and has no backwash system. A $\frac{1}{8}^{th}$ of an inch opening in the filter will pass 3,175-micron particles. Graves, '896 describes a multistage filtration process, which aims to filter particles as small as 1000 microns. However this process is dependent upon chlorination, aerobic agitation, and optional de-chlorination, thus requiring electrical power and chemicals. When the filters clog, the unit must be removed and cleaned. As with the previous reference this requires exposing and opening the tank to clean or replace the filter, again a substantial undertaking. No dosing mechanism is provided so, with the exception of the filter, the septic system has the site limitations of a simple gravity fed system.

Filtration systems are generally categorized by the particle size, which will pass through them. Particle size is generally measured in microns. A Micron is one millionth of a meter or 40 millionth of an inch. For reference the high quality drinking water filters block particles larger than 5 microns from passing through them. Some coarse drinking water filters would pass 30 micron particles. With respect to filtration in a septic system, to pass solids of over 3,000 microns is tantamount to no filtration at all. A great majority of suspended particles in a septic tank are much smaller; therefore much finer filter media are necessary to clean the effluent significantly. It becomes clear why Ball, '635 cites that the filter requires cleaning only as often as the container (the septic tank) requires pumping to remove accumulated sludge.

It is difficult to establish the suspended particle size distribution of the effluent, because each family's life style is different. Assuming a linear distribution of particle size the following table will illustrate the importance of filtration medium.

TABLE I

| Quantity of suspended solids in 76 million lbs (38,000 Tons) of effluent processed over a lifetime of 25 years. | | |
|---|---|---|
| Percent (by Weight) | | Quantity |
| 1.0% | (10,000 ppm.) | 380 Tons |
| 0.1% | (1,000 ppm.) | 38 Tons |
| 0.001% | (100 ppm.) | 3.8 Tons |
| 0.0001% | (10 ppm.) | 760 lbs. |

Even at the lower concentrations there is sufficient quantity and volume of suspended solids, which if not removed by filtration would plug up any septic field. Clearly, the importance of good effluent filtration cannot be overemphasized.

By comparison this invention filters particles as small as 100 to 200 microns by using a super fine filter. A 100 mesh screen (10,000 holes per square inch) will filter 180 micron or larger particles and a 150 mesh screen (22,500 holes per square inch) which will filter 100 micron or larger particles, and the effluent will be almost as clean with respect to suspended particles as the domestic water supply, a great benefit for the life of the septic field.

The present invention shows the use of a precision and true siphon to dose and filter the liquid extracted from the central clear zone of a septic tank. The unit is contained in a housing mounted and ported on the discharge side of a septic tank. Liquid flows into the housing from the bottom thereof, passes through a fine mesh basket strainer or filter, and rises in the housing until enough is collected to start the siphon. Then the siphon is initiated through the lifting of a float and the proper dose is delivered to a distribution box. After delivery of the dose volume the siphon is broken, and a predetermined short time thereafter a remote timer triggers a solenoid valve, which sends pressurized domestic water to backwash the filter for a predetermined time after which the system becomes ready for the next dosing cycle.

Referring now to FIG. 11, there is shown a typical septic system 120 comprising a septic tank 122, a drainpipe 124, and a distribution box 126. The inflow 127 to the septic system 120 is delivered through a pipe 121 emanating from a building or house (not shown) and received at the inlet of the septic tank 122. A septic field towards which the outflow 128 from the distribution box 126 is directed is not shown.

The total elevation difference 130 is defined as the difference in elevation between the bottom of the inlet pipe 121 and the bottom of the lowest level in the distribution box 126. The total elevation difference 130 can be further broken down to the sum of the septic tank drop 132, the pitch drop 134, and the distribution box drop 136.

The selection of an effluent delivery system i.e. a gravity siphon, or a pump system depends on the total elevation difference 130. In most health jurisdictions the minimum required difference 132 between the inlet and outlet of the septic tank is about three inches, but in some cases it can be as much as six inches or more. The pitch drop 134 depends upon the distance 135 between the septic tank and the distribution box. Most health departments require that a pitch or gradient of 1 in 100 or about ⅛ of an inch per foot of drainpipe length be maintained. The distribution box drop 136 is normally about one inch. The pitch drop 134 dictates the choice of an effluent disposal system as follows:

a. If the pitch drop 134 is insufficient to maintain the required pitch or if the distribution box is at a higher elevation than the liquid level in the septic tank, then it becomes necessary to install a pumping system.

b. If the pitch drop 134 is just enough to maintain a pitch of 1 in 100, then a simple gravity system is the only choice.

c. If the pitch drop 134 is large enough to meet the incremental elevation differential requirements, then a classical Bell Siphon (not shown) or the so-called siphon systems (some of which are included in the list of patents cited i.e. Ball, '323 and Richard, '434) on the market can be used.

Referring to FIG. 12, these systems 140 require a dosing chamber 148 downstream of the septic tank 142, which holds the entire dose volume. Depending upon the dose volume, which governs the dimensions of the dosing chamber 148, the incremental siphon drop 147 can be anywhere from 6 to 18 inches on top of the pitch and distribution box drop 149. The pitch drop here is measured from the input to the drainpipe 144 near the bottom of dosing chamber 148. The dose volume is denoted in the figure by 146. The septic tank drop 143 is measured between the bottoms of the entry and exit pipes of the tank 142, and plays no role in the performance of the above mentioned so called siphon systems.

Neither, Ball, '323 nor Richard, '434 are true siphons, because the effluent is always under a positive hydrostatic head, and there is no vacuum anywhere in the drainpipe. A true siphon is defined as a continuous tube (siphon tube) that allows liquid to drain, without requiring pumping assistance, from a reservoir at a higher elevation to a point at a lower elevation, where the tube passes through an intermediate point that is higher than the reservoir. The up flow from the reservoir is driven by the pressure difference created by the vacuum formed by the siphon process at the highest point of the siphon tube.

SUMMARY OF THE INVENTION

It is an object of this invention to provide an economical and reliable true siphon operated dosing system to prolong the life of septic fields of residential dwellings or commercial buildings.

It is yet another object of this invention to provide an economical and reliable true siphon operated dosing system that can be deployed in cases where the pitch drop is insufficient even for a simple gravity system.

It is still another object of this invention to provide an economical and reliable true siphon operated dosing system that utilizes the septic tank drop to provide additional hydrostatic head to increase the flow rate of the siphon.

It is another object of this invention to provide an economical and reliable true siphon operated dosing system that utilizes the full difference in elevation to drive the siphon flow at a high velocity.

It is yet another object of this invention to provide an economical and reliable true siphon operated dosing system that utilizes a float-operated valve to initially block the flow of screened effluent into the drainpipe.

It is still another object of this invention to provide an economical and reliable true siphon operated dosing system that passes the effluent through a fine mesh screen filter prior to its entry into the working section of the siphon.

It is still another object of this invention to provide an economical and reliable true siphon operated dosing system that backwashes the fine mesh filter screen after each dosing cycle.

These objects are accomplished by a precision siphoning unit containing two cylindrical control floats arranged respectively above and below, and concentric with a stationary cylindrical member having large central flow passages surrounded by a plurality of smaller flow passages. An elastic sealing surface on the underside of the upper float provides a seal across inner and outer valve seats on top of the cylindrical stationary member thereby blocking flow through the large flow passages. An elastic sealing surface on top of the lower float seals the plurality of smaller flow passages protruding out of the bottom of the stationary member. The floats and the stationary member are housed in a cylindrical barrel having a top cover, an open bottom, and a side opening. The stationary member is sealed to the inside of the barrel. A fine mesh screen basket filter of a diameter, slightly larger than that of the barrel is supported in a wire mesh basket, which in turn is fastened to the bottom of the barrel. A central pipe passes through the barrel, the floats, and the stationary member. A rotatable sprinkler arm is attached to the bottom of the central pipe with a rotatable seal. The sprinkler arm fits inside the basket filter. The barrel assembly with the basket filter and sprinkler are contained in a larger diameter cylindrical outer housing with a top cover. A water pipe passes through the top covers of the barrel and the outer housing, and is connected, through a solenoid valve, to a pressurized domestic water supply in the house or building, which is served by the septic system. The water pipe enters the central pipe concentrically and terminates therein. The outer cylindrical housing is mounted on the discharge side of the septic tank service the house or building.

Effluent from the clear zone of the septic tank passes through an inlet pipe into the bottom of the outer cylindrical housing, where it first passes through the basket filter. As the liquid level rises in the septic tank due to incoming waste, the now filtered effluent is blocked from passing through to the discharge port of the precision siphon unit by cooperation of the floats and the stationary member. When the liquid rises above the end of the inner water pipe, the air pressure therein begins to rise. The liquid continues to rise in the housing and in the central pipe, building up head, until it passes through spillover ports at the top of the annulus between inner and outer central pipes. The spilled over liquid falls into the compartment surrounding the upper float. The float then becomes buoyant, rises, and releases a sudden surge of flow through the central flow passages. The flow passes through the exit port of the barrel taking along with it most of the air in the upper float compartment, and the drainpipe.

Just prior to the upper float becoming buoyant a pressure switch, located in the building and connected to the water pipe, senses the increase in air pressure in the water pipe. At a preset pressure, the pressure switch triggers a timer which, after a time delay, initiates the opening of a solenoid valve in the building which sends a flow of high pressure domestic water through the water pipe for a short time period (about one minute). This sudden rush of high-pressure water pushes the remaining air out of the siphon unit, the drainpipe, and the system, now primed, initiates the siphon flow. The flow of liquid continues at a gradually diminishing rate as the liquid level in the tank drops. When the liquid level between the barrel and the outer housing falls below vent openings in the barrel, which are located below the level of the floats, air enters the barrel, the floats drop, and the siphon is broken.

After a time delay to assure that the siphon flow has ceased, the timer in the building or house again opens the solenoid valve for about five minutes to send a second flow of pressurized domestic water through the central pipe causing the sprinkler in the siphon unit to back flush the fine mesh basket screen filter, thereby driving the accumulated particulate matter on the filter screen back into the septic tank.

It is yet another object of this invention to provide a method for retrofitting the precision siphon unit of this invention into an existing conventional gravity septic system without removing any of the components of the original system.

This object is accomplished by lowering the exit port of the existing septic tank by creating a new exit port and plugging the old port, placing a new smaller diameter flexible drainpipe into the existing drainpipe, and fitting a new discharge pan into the existing distribution box.

It is another object of this invention to provide an economical and reliable true siphon operated dosing system to prolong the life of septic fields of residential dwellings or commercial buildings wherein backwashing of said fine mesh filter is accomplished without a water supply connection of the dosing unit to the building being serviced thereby eliminating the need for a control box in the building.

This object is accomplished by backwashing the fine mesh filter with the volume of liquid trapped in the dosing unit after the siphon is broken.

BRIEF DESCRIPTION OF THE DRAWINGS

FIG. 11 is a diagram showing the configuration of a conventional septic tank waste disposal system.

FIG. 12 is diagram showing a conventional septic system utilizing prior art dosing technology.

DESCRIPTION OF THE PREFERRED EMBODIMENTS

Figure 1:
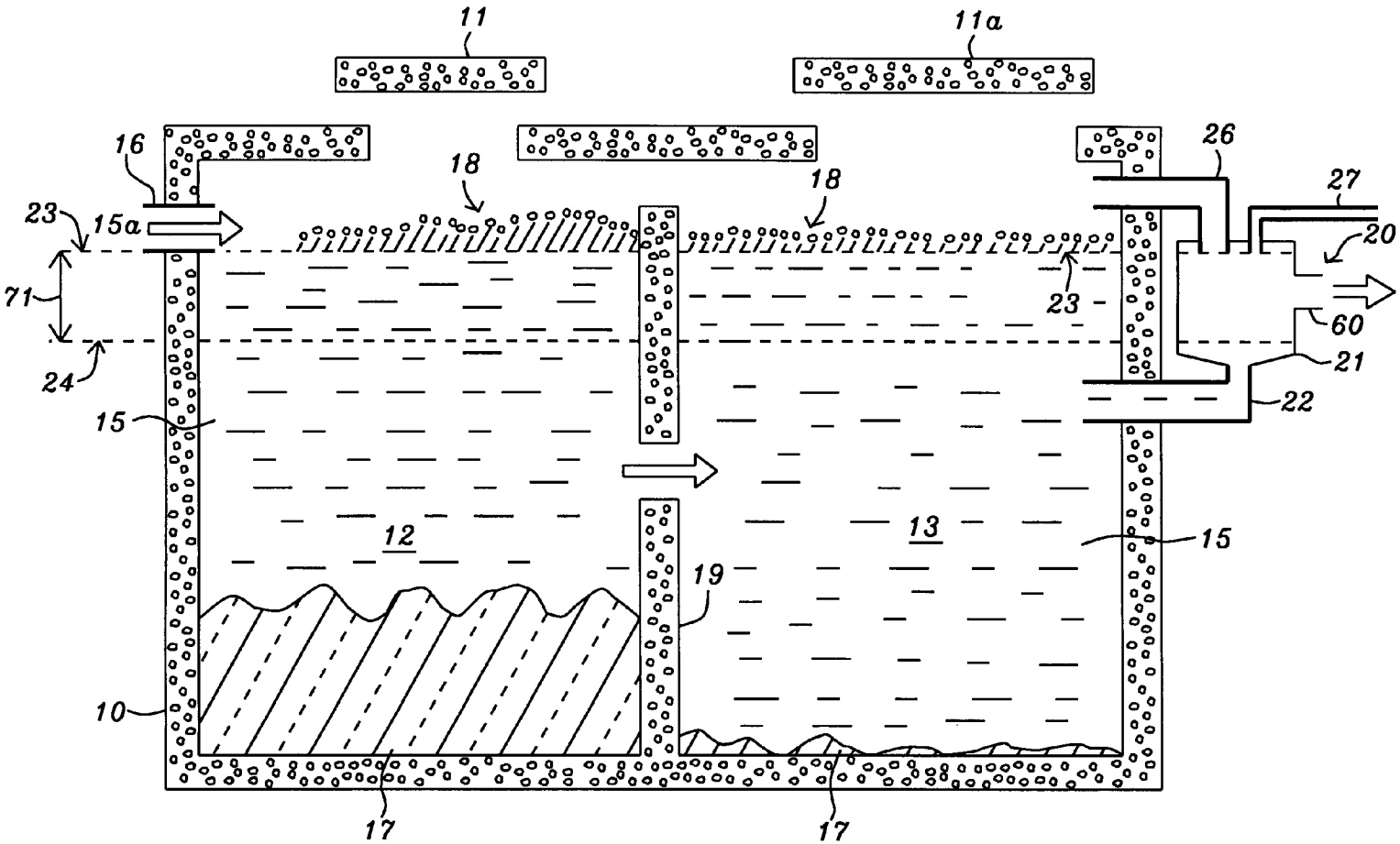
FIG. 1 shows a cross section of a modern two-compartment septic tank with the precision siphon unit of the present invention attached on the outside and downstream of the septic tank.

In a first embodiment of this invention the construction and functioning of an economical and reliable true siphon operated dosing system to prolong the life of septic fields of residential homes or commercial buildings is described. Referring first to FIG. 1, there is shown a cross section of a modern two-compartment septic tank 10. The tank is generally made of cast concrete but may be constructed of a tough polymer material. The tank 10 is provided with removable covers 11 and 11*a*, which provide access to compartments 12 and 13 respectively. In the figures boxed arrows indicate the flow of effluent ⇒ Septic waste effluent 15*a* emanating from a building or a house (not shown) enters the first compartment 12 of the tank 10 through an inlet port 16. Over time, a settling process takes place as well as fermentation caused by the action of anaerobic bacteria. Solids in the effluent settle to the bottom to form a sludge layer 17. A scum layer 18 of buoyant solids forms on top of a relatively clear liquid 15. Clear liquid from the first compartment flows through an opening in a baffle 19 into the second compartment where the settling process continues but far less scum and sludge are produced.

The precision siphon apparatus 20 of the invention is enclosed in an outer housing 21. Effluent 15 from the clear center zone of the septic tank 10 enters the housing 21 through an inlet conduit 22 at the bottom and rises therein as the flow accumulates in the septic tank. The bottom of the outer housing 21 is conical, and the inlet conduit 22 is pitched down towards the septic tank 10 to facilitate the return of debris to the septic tank during backwash of the siphon unit. The draw down 71 in the septic tank 10 and precision siphon 20 combination, that is, the difference between the highest 23 and lowest 24 liquid levels is determined by the configuration of the precision siphon apparatus 20. The draw down 71 will be presented later when the functioning of the precision siphon is described. An air vent 26 from the top of outer housing 21 into the top portion of the septic tank above the highest liquid level is provided. A water pipe 27 is connected to the domestic water supply and a control box in the building or house (not shown). Note that the level 23 represents the highest level of septic effluent in the combined septic tank 10 and precision siphon 20 and is determined by a feature of the precision siphon unit, which will be discussed later.

Figure 2:
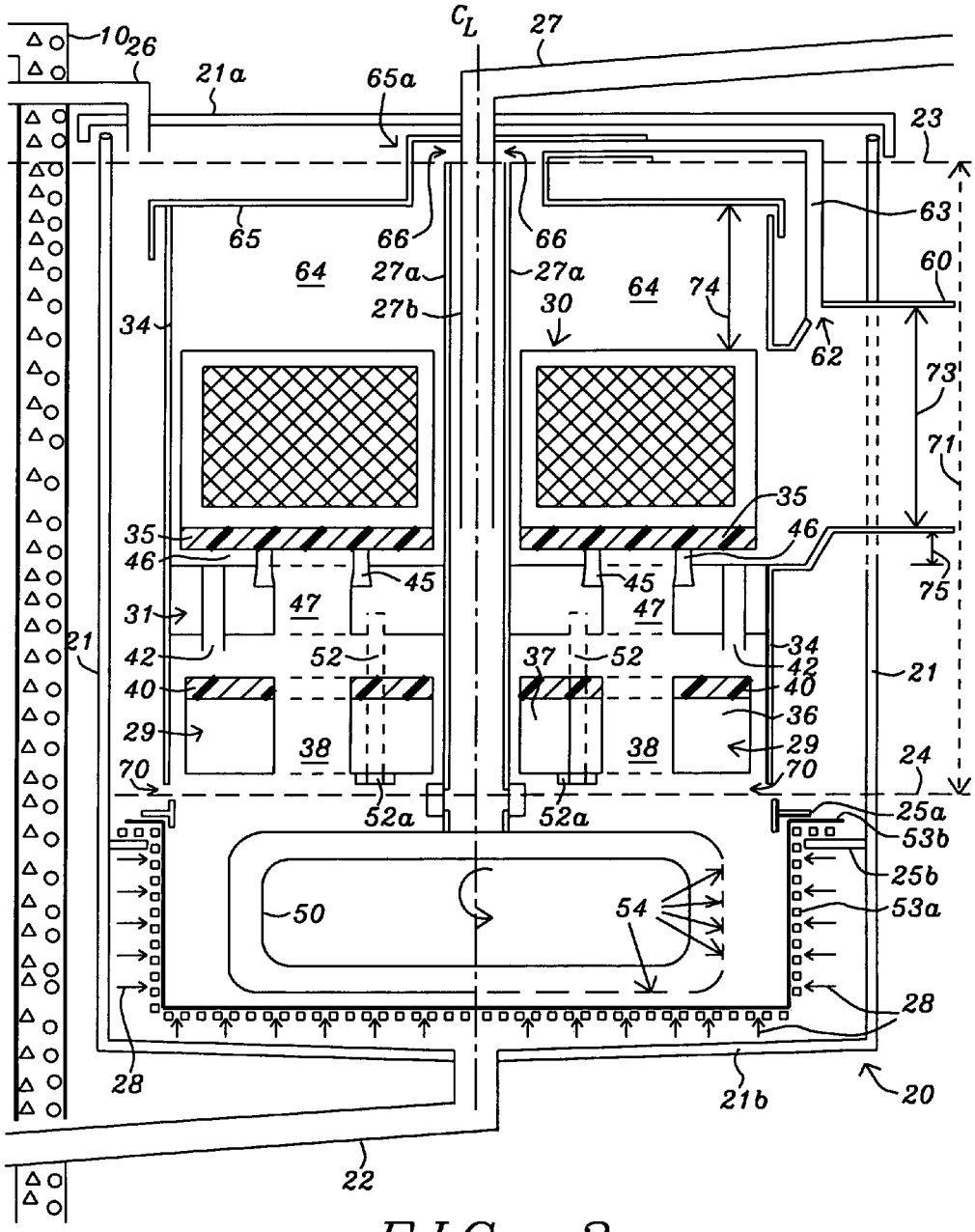
FIG. 2 shows a cross section of the precision siphon-dosing unit taught by this invention.
Figure 3:
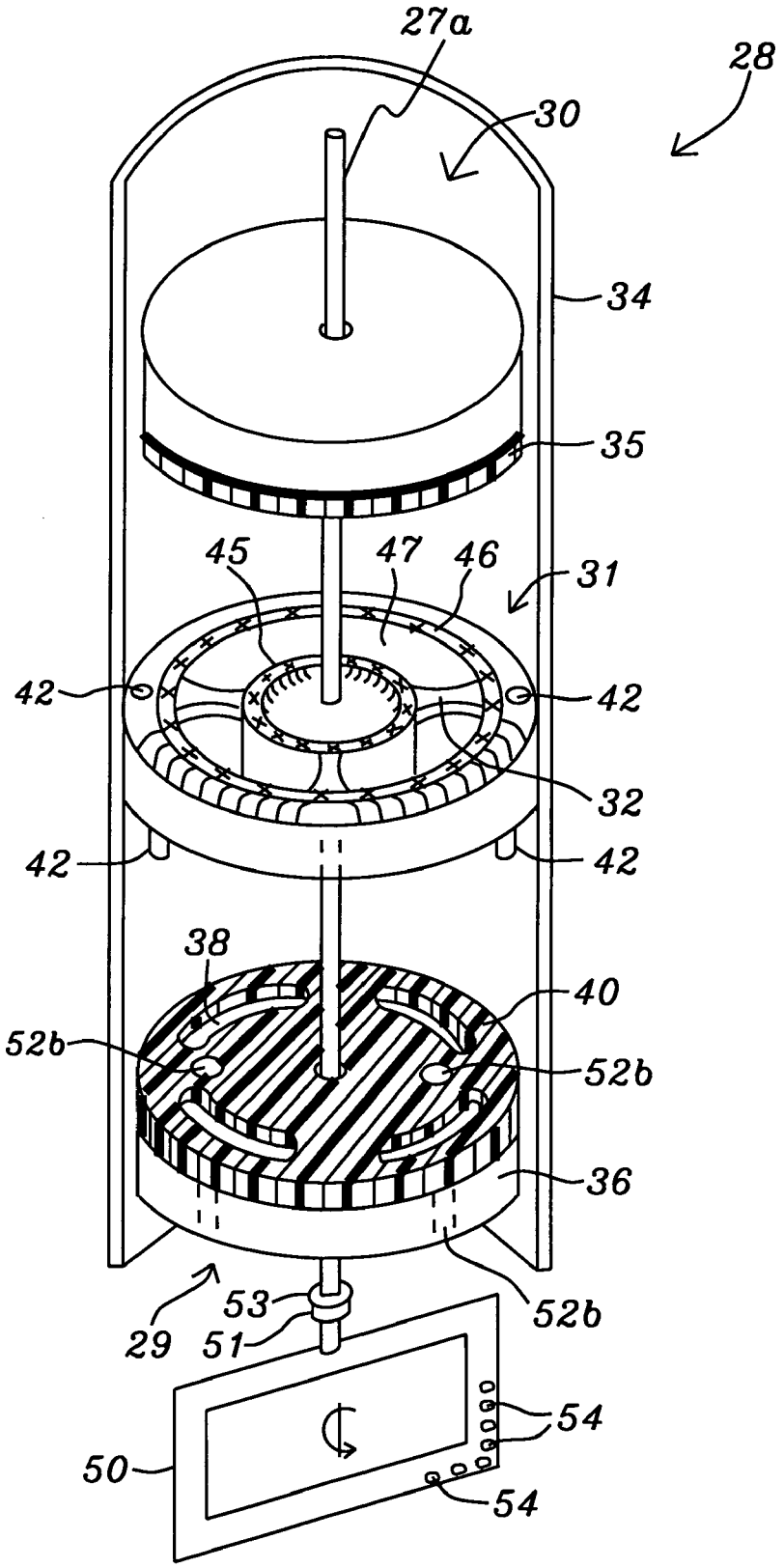
FIG. 3 is an isometric view of the core floats and spray assembly of the precision siphon unit taught by this invention.

Referring now to FIG. 2 a cross section of the precision siphon-dosing unit 20 as taught by this invention is shown. The isometric view of the core float and spray assembly 28 of the unit shown in FIG. 3 may be of help in visualizing the construction. The float and spray assembly 28 consists of a lower float 29, an upper float 30, and a stationary central unit 31 in between, the three components operating within a cylindrical barrel 34. The two floats have a smaller diameter than the inside diameter of the barrel so that the may travel freely along the axis of the barrel, guided by a central pipe 27*a*. The barrel 34 is formed of PVC, high density polyethylene, or other inert polymer material, which will not corrode or deform in the septic effluent environment. The barrel 34 has an inner diameter of about 4 inches. The upper float 30, the larger of the two floats, has a diameter approximately $1/16^{th}$ of an inch smaller than the inner diameter of the barrel 34. This clearance also allows liquid to flow around the float towards the bottom. The float 30 preferably consists of an injection molded outer shell made of the same material as the barrel 34. The cavity is filled with a closed cell foam and is weighted to meet the performance requirements for the float 30. An elastic gasket disk 35 is bonded onto the lower surface of the float 30. The lower float 29 is also preferably made of the same material as the barrel and the upper float. Both upper and lower floats are designed so that their weight is about half the weight of the volume of displaced liquid respectively. It is the intent that when fully submerged in the liquid, each float has a net upward buoyancy approximately equal to its weight so that it can exert sufficient force to close the respective flow passages without leakage.

The elastic gasket disk 35 is formed of a soft durable rubber or a synthetic elastic polymer. The thickness of the elastic gasket disk is approximately one sixteenth of an inch. The upper float 30 has an additional design requirement that it be of sufficient weight to block the passage of effluent thru the main flow passages 47 by exerting sufficient down force on the seating surfaces 45 and 46 when the liquid is near its highest level 23.

The weight of the upper float 30 including the gasket disk 35 bonded thereto is preferably between about 10 and 20 percent greater than the maximum upward hydrostatic force exerted on the bottom of the float between the inner and outer sealing seats 45 and 46 in the closed position when the liquid level in the septic tank is at its highest. The volume of the upper float 30 preferably should be such that its net buoyancy when totally immersed in liquid is equal to or more than the combined weight of the upper float 30 and the gasket disk 35.

Figure 5A:
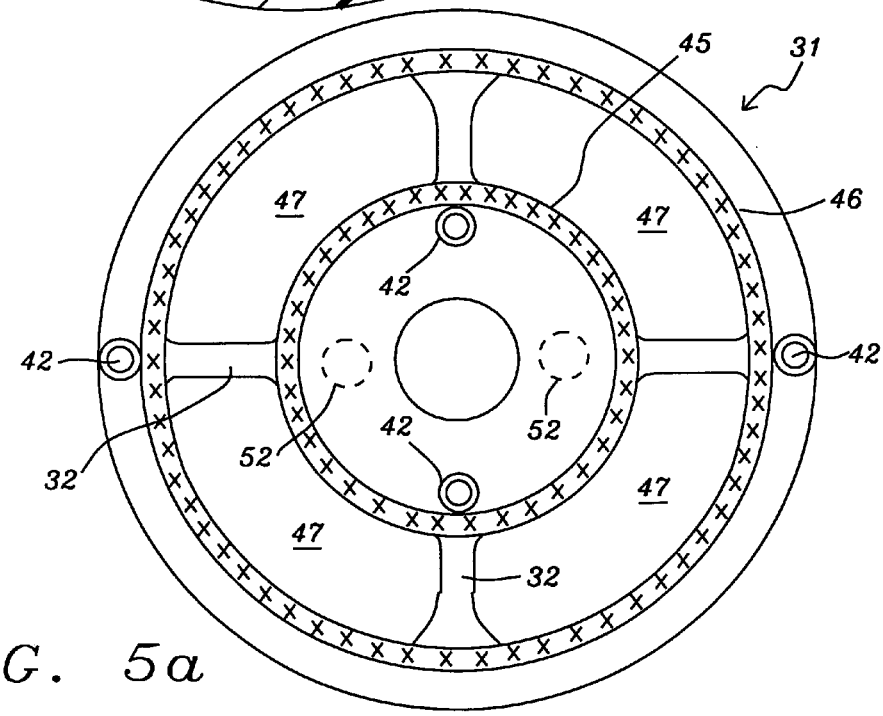
FIG. 5*a* is a top view of the stationary central unit of the float and spray assembly of the invention.
Figure 5B:
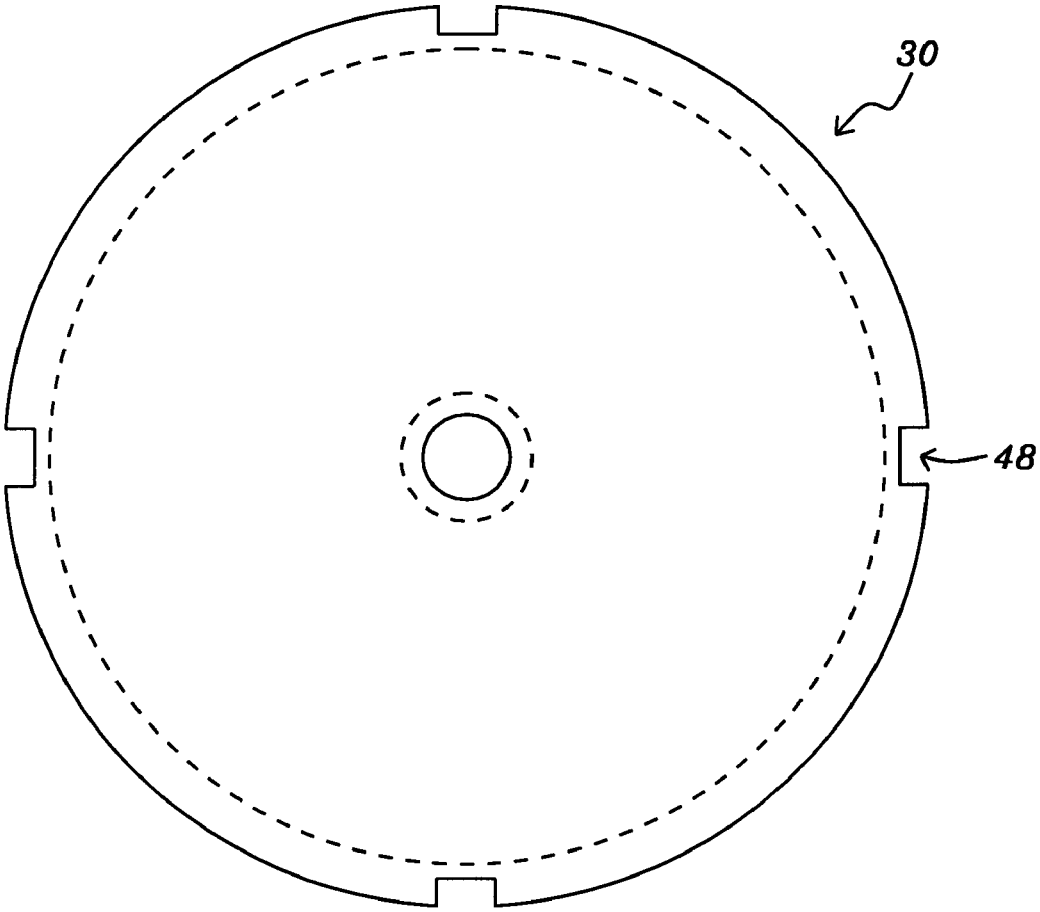
FIG. 5*b* is a top view of the upper float of the float and spray assembly of the invention.

Referring to FIG. 5*b*, there is shown a top view of the upper float 30. In operation the upper float becomes buoyant only when liquid enters the upper chamber 64 from above. The liquid passes down along the sides of the upper float 30. In order to assure free flow of liquid to the base of the float, channels 48 are formed along the sides of the float.

The lower float 29 has an outer segment 36 and a concentric inner segment 37 (FIG. 2, not shown in FIG. 3) connected to the outer segment by hollow structural webs (not shown). Large flow passages 38 between the inner segment 37 and outer segment 36 assure rapid deployment of the dose once the siphon cycle begins. Vertical sleeves 52*b* pass through the body of the lower float allow the passage of retaining bolts 52. The retaining bolts 52 serve as alignment guides as well as supports when the lower float is not buoyant. An elastic gasket 40, made of the same material as elastic gasket 35, is bonded to the top surface of the lower float 29. The gasket 40 has punched openings corresponding to the flow passages 38 and retaining bolt sleeves 52*b*. The hollow cavity inside each float segment is filled with closed cell foam. The combined weight of the float 29 and the elastic gasket 40 should be about half the weight of displaced volume of liquid. The elastic gasket material forms a watertight seal when the lower float rises and presses against drain tubes 42, which pass through and extend beneath the bottoms of the inner and outer sections of the stationary member 31 as will be explained later. When the lower float is not buoyant it rests upon the wide heads 52*a* of the retaining bolts 52 which are threaded into the lower part of the central unit 31 through the lower float.

Figure 4:
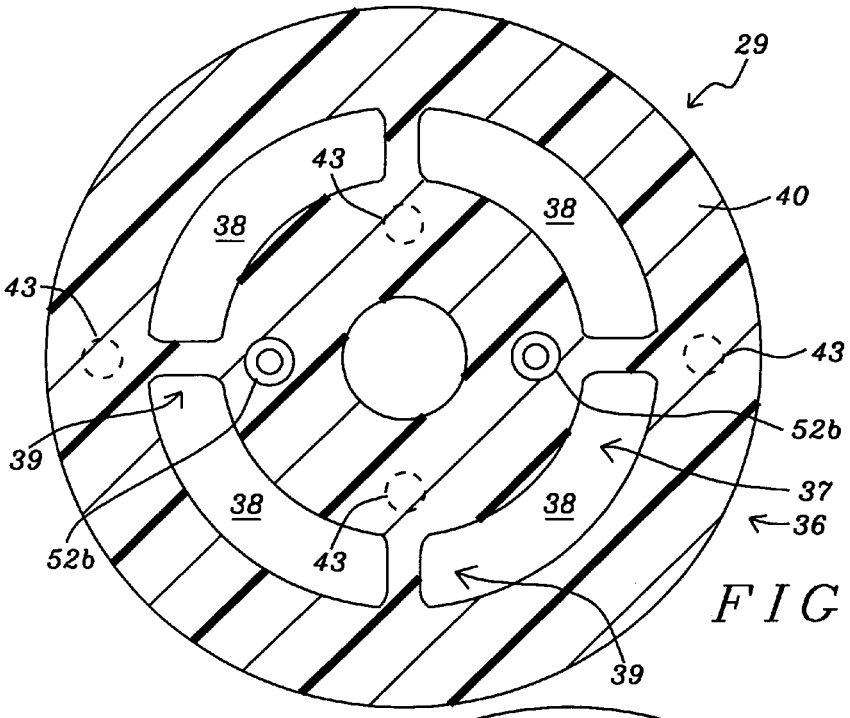
FIG. 4 is a top view of the lower float of the float and spray assembly of this invention.

A top view of the lower float 29 is shown in FIG. 4. The places of contact 43 where the drain tubes 42 press into the elastic gasket 40 are shown in phantom in the figure. The structural webs which connect the outer 36 and inner 37 segments lie under the regions 39 of the gasket 40.

The stationary member unit 31 is a solid, cast or molded body which houses the seating surfaces for the two floats. The stationary member 31 is sealed into the barrel 34 and onto the central pipe 27*a* to make it water tight all around its outer and inner perimeters. The sealing seats for the lower float 29 consist of the machined sharp edged bottoms of the drain tubes 42, which project beneath the bottom of the stationary member 31 and have already been mentioned supra. The seating surfaces 45 and 46 for the upper float are machined and sharp edged to seal off the main flow passages 47 which pass through the stationary member 31 and the subjacent lower float 29, thereby preventing the flow of filtered effluent around the outer portion of the upper float 30 and inner portion around the central pipe 27, to prevent it from becoming buoyant and prematurely releasing the main surge which will initiate the siphon. FIG. 5*a* is a top view of the stationary member 31 showing the configuration of the seals 45 and 46 and the drain tubes 42. The structural webs 32 between the flow passages 47 connect the inner and outer portions of the stationary member 31. The retaining bolts 52 which pass through the sleeves 52*b* in the lower float are threaded into the underside of the stationary member 31. The threaded holes 52*c* which receive these bolts are shown in phantom in FIG. 5*a*.

Returning to FIGS. 2 and 3, the remaining features of the precision siphon are described. A fine mesh screen filter 53*a* is supported on a rigid wire basket 53*b*. The basket 53*b* is fastened to a lip 25*a* on the base of the barrel 34 and is also supported by a second lip 25*b* extending from the housing 21. A rotatable sprinkler tube 50 is attached to the bottom of the central pipe 27*a* with a rotatable seal 51. The sprinkler tube 50 fits within the basket 53*b*. A plurality of small openings 54 are arranged along the bottom and one side of the sprinkler tube 50 so that when pressurized water is forced through the openings the sprinkler tube 50 rotates slowly, dislodging and flushing collected particulates from over the entire surface of the filter 53*a* in a backwashing action.

The outer housing 21 has a tightly fitting top cover 21*a* through which the vent pipe 26 and the water pipe 27 enter the unit. The bottom portion 21*b* of the housing 21. is funnel shaped towards the inlet conduit 22.

The exit port of the precision siphon-dosing unit consists of a drainpipe 60 emanating at approximately at the same level as the upper float 30 at rest on its seats 45 and 46. A tube 63 is routed from an opening 62 at the top of the drainpipe 60 to the chamber 64 in the top of the barrel 34, which is fitted with an airtight cover 65.

A plurality of spillover ports 66 is located in the top of the annulus between the central pipe 27*a* and the extension 27*b*. of the water pipe 27. The spillover ports allow effluent to flow into the upper chamber 64. The elevation of the spillover ports 66 in the dome 65*a* determines the highest level 23 of liquid in the entire system. The lowest liquid level 24 is defined in the vicinity of openings 70 at the base of the barrel 34. The distance 71 now becomes the draw down of the entire system.

To start the operation of the siphon, on the cue of a pressure sensor, a short burst of high pressure domestic water is delivered into the unit via the water pipe 27. The water comes out of the spillover ports 66 after the upper float 30 has either lifted or is about to be lifted, the water fills the upper chamber 64 completely, and pushes any remaining air through the siphon tube 63 into the drainpipe 60 and eventually out of the system. The top of central pipe 27*a* protrudes into a dome 65*a* at the top of the cover 65 and is fastened to the inner pipe 27*b* which is the extension of the water pipe 27 into the unit.

The net flow through area of the fine mesh screen filter 53*a* is preferably at least about ten times the flow area of the drainpipe 60. This reduces the impact velocity of the suspended particles against the fine mesh screen thus making it easier to dislodge them by the subsequent backwash action. The net flow through area of a 100 mesh screen is about 45% of the face area and a 150 mesh screen is about 35% open.

The draw down 71 and the diameter of drainpipe 60 determine the internal configuration of the precision siphon unit. If the inner diameter 73 of the drainpipe 60 is fixed at 2 inches nominal, the minimum height of the barrel 34 above the bottom of drainpipe 60 or from the top of the seats 45 and 46 should be the sum of the inner diameter 73 of the drainpipe and the top clearance 74 which must be the height of upper float 30 including the thickness of the soft elastic disk 35. This height plus the height of spillover ports 66 in the dome 65*a* determines the maximum hydrostatic pressure that the upper float 30 must withstand in order to keep the liquid from discharging into the drainpipe 60. After the liquid level in the annulus between the central pipe 27*a* and concentric inner pipe 27*b* pipes has reached the spillover ports 66 the upper chamber 64 of the barrel begins to fill. For the upper float 30 to become buoyant it is necessary that liquid should accumulate in the space around the lower half of the float and on the outside of seating surfaces 45 and 46. The upper float 30 should be immersed in the liquid to a depth, which is near the depth to which the float will sink while freely floating in the liquid. To achieve this accumulation of liquid, a drainpipe uplift 75 is provided. The cross sectional area of the flow passages 38 and 47 must be equal to or greater than the internal flow area of the drain pipe 60 to assure efficient operation of the siphon.

Figure 6:
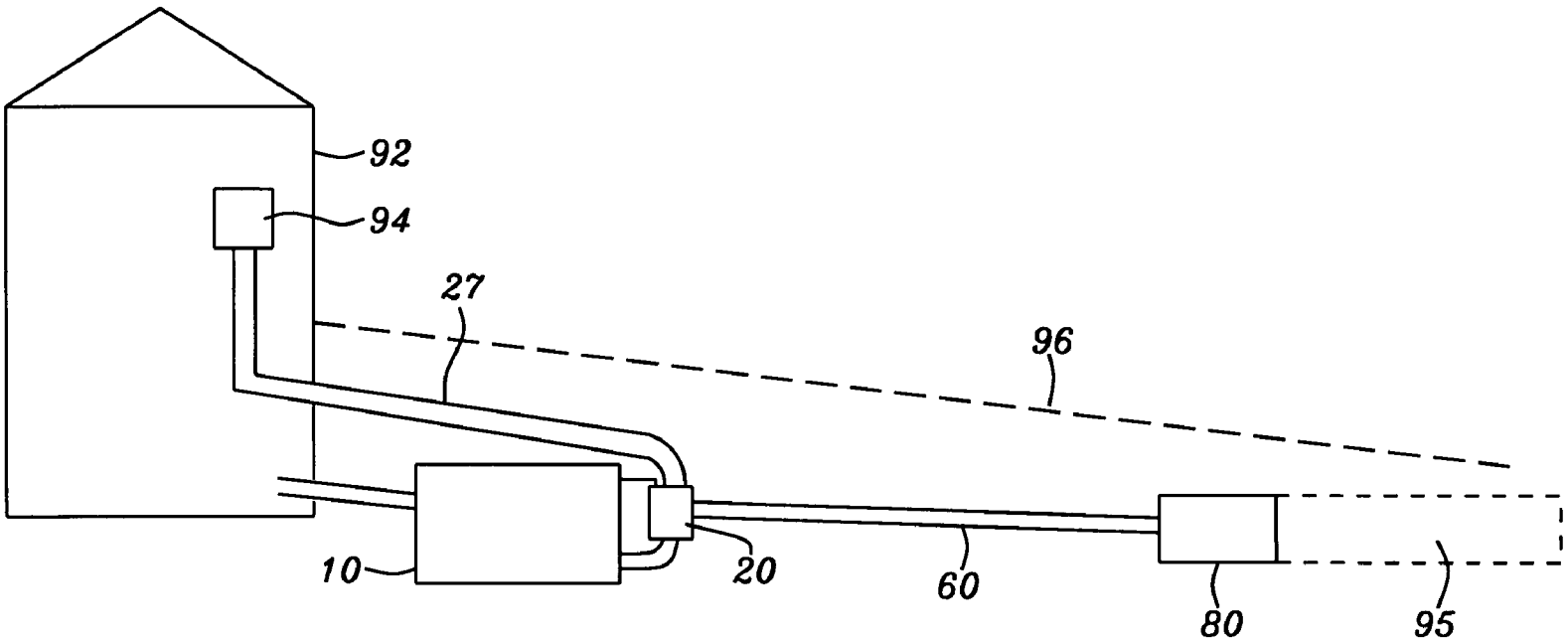
FIG. 6 is a block diagram showing the layout of the interface between the building or house and the precision siphon-dosing system (installed on the outside of the septic tank) of this invention.

Referring now to FIG. 6 there is shown a block diagram of a complete septic system taught by this invention including a building 92, from which the septic flow emanates and enters the septic tank 10 and precision siphon 20 assembly (FIG. 1,2). The drainpipe 60 delivers a dose from the siphon unit to a discharge pan 83 in the distribution box 80 (FIG. 7*a*), which in turn passes it into the septic field 95. The pipe 27 is connected to a domestic water supply in the building 92 through a solenoid switch. The dashed line 96 indicates the grade of the land. The pipe 27 must be buried or otherwise insulated to protect from freezing and damage. It is also laid from the building to the dosing unit at a downward pitch to allow for drainage into the dosing unit 20 when the water is turned off.

Figure 9:
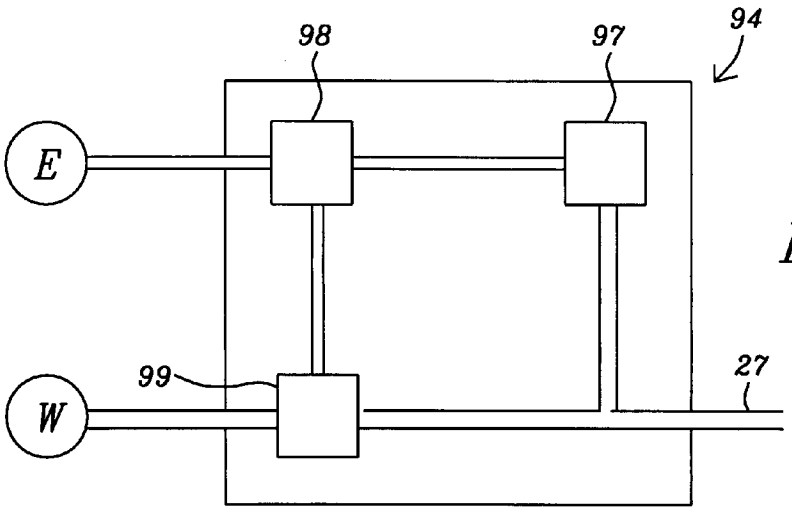
FIG. 9 is a diagram of the configuration of a control box for the precision siphon dosing system taught by this invention

A control box 94 located within the building 92, illustrated in detail in FIG. 9, communicates with the precision siphon unit 20 through the water pipe 27. When the pipe is empty and at atmospheric pressure, the system senses the dormancy of the siphon cycle. When sensor switch 97 senses a predetermined increase in air pressure in the pipe due to rising effluent in the dosing unit, it indicates that the liquid level in the annulus between inner and outer pipes 27*a* and 27*b* in the siphon unit 20 is at or near the top. At this time the sensor switch 97 triggers the timer 98 which, in turn, energizes the solenoid valve 99. The control box 94 receives electrical power to operate its components from the buildings electrical supply E. The solenoid valve 99 operates to deliver timed flows of pressurized water from the buildings domestic water supply W through the water pipe 27 and into the dosing unit, first to initiate the siphon flow and later to backwash the filter 53*a*. The timer 98 is set to allow a fixed time to elapse to assure that the siphon cycle is completed before starting the backwash. The timer 98 then actuates the solenoid valve 99 for a predetermined period, typically about five minutes, causing a flow of domestic water to operate the backwash sprinkler 50 for a predetermined time after which operation ceases and the siphon unit 20 is returned to its starting configuration, ready to accumulate the next dose. Using a sensing system as described here, eliminates the need to supply electric service to the siphon unit 20, which would have been costly and hazardous.

The distribution box 80, which receives the dosed output of the precision dosing unit 20 through the discharge pipe 60, also must be modified in order to cooperate with the dosing unit during a siphon flow.

Figure 7A:
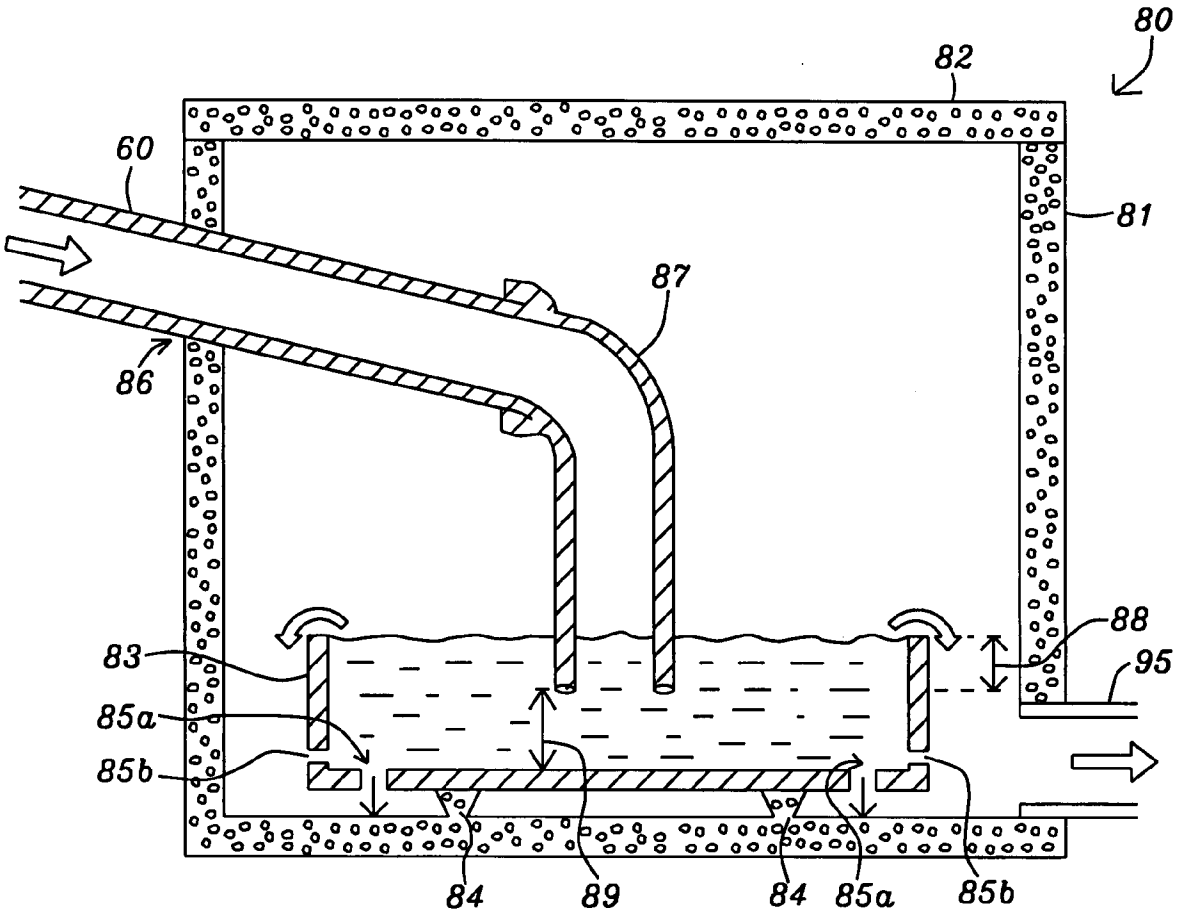
FIGS. 7*a* and 7*b* are a cross sectional views showing the configuration of a distribution box arrangement including a discharge pan and discharge elbow which cooperates with the precision siphon-dosing unit taught by this invention.

FIG. 7*a* shows installation of discharge pan 83 in a standard distribution box 81. The box 80 is fitted with a cover 82. The discharge pan 83 is connected to the drainpipe elbow 87 by connecting webs to secure the spacing between the two. The webs 83*a* are illustrated in the top view and cross section of the pan assembly shown in FIGS. 7*b* and 7*c* respectively. There are small openings 85 on the lower side and bottom of the drain pan 83, which allow the tray to drain after the siphon ceases. During siphon flow, drainage through the small openings 85 is insignificant and the tray is quickly filled and the primary discharge therefrom is overflow. However, it is essential to drain the tray 83, particularly in colder climates, to avoid freezing. The small openings 85 serve this purpose. The overflow is discharged from the distribution box 80 though the exit opening 90 at the bottom of the box and into the septic field (not shown).

During a siphon operation in the precision siphon unit 20 the filtered effluent discharge therefrom is delivered into the distribution box 80 though the drainpipe 60 entering at the input port 86. of the distribution box 80. A discharge elbow 87 is fitted on the end of the pipe 60 to deliver the effluent vertically into the tray 83. The discharge elbow 87 must extend into the tray 83 so that when the tray is filled, the discharge end of the elbow 87 must be submerged at least one fourth of an inch in the liquid to form an air lock. In order to provide unrestricted flow area, the end of discharge elbow 87 must be above the bottom of the tray 83 one fourth of the inside diameter at the end of the elbow. This geometry is fixed by the connecting structural webs 83*a* between the tray 83 and the elbow 87.

Figure 7B:
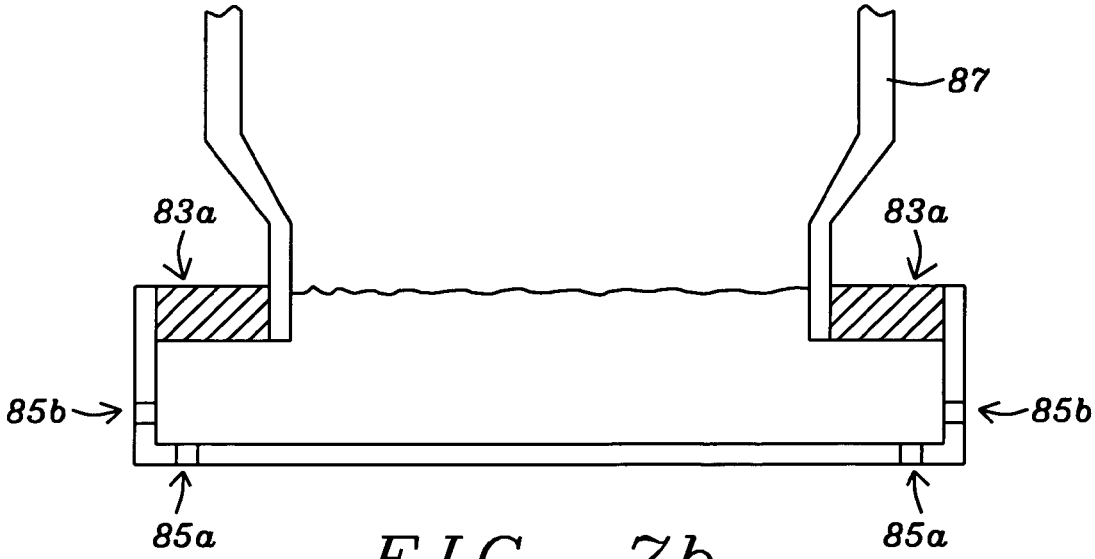
Figure 7C:
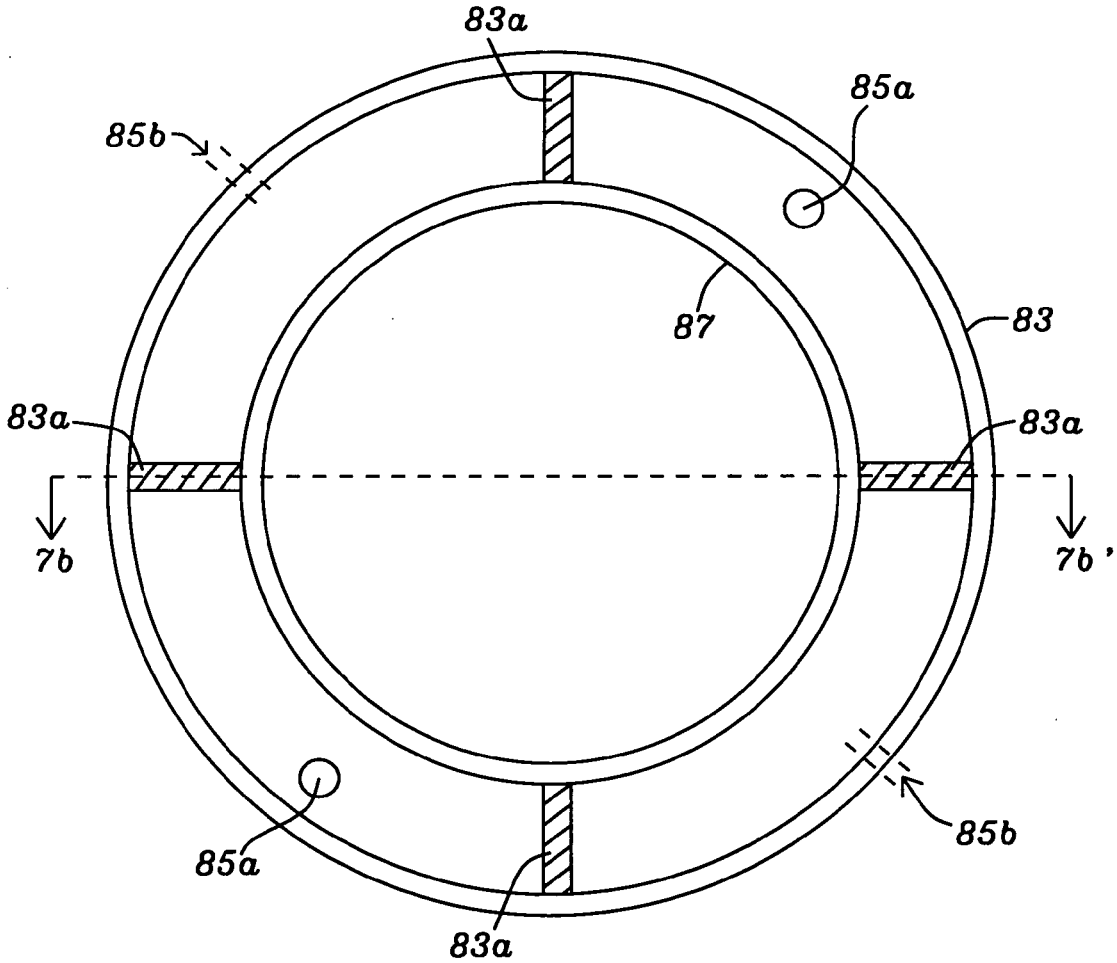
FIG. 7*c* is a top view of the discharge pan illustrated in FIGS. 7*a* and 7*b* showing an arrangement of drain holes in the pan and the locations of webs which physically connect the discharge elbow to the pan.

Referring now to FIG. 7*b*, there is shown a cross section of the discharge pan at the end of the discharge elbow 87, illustrating the fastening of the elbow to the pan with structural webs 83*a*. FIG. 7*c* is a top view of a horizontal cross section of the discharge pan taken at the level b-b'. where four webs and four drainage holes are shown. While additional openings and webs may be added, it is found that the arrangement of openings and webs shown in the figures is sufficient.

The detailed step-by-step operation of the precision siphon of this embodiment will now be described and is illustrated in FIGS. 8*a* through 8*e* which show the status of the precision siphon unit at several liquid levels 68. The left hand sides of these figures show the corresponding liquid level 68*a* in a portion of the septic tank 10 during each step.

The starting point of the siphon cycle is chosen here to be the point at which the level of septic effluent 15 has reached the openings 70 in the bottom of the barrel 34. This point is reached on the initial filling of the septic tank 10 and also thereafter when the siphon is broken at the end of each dose delivery.

Figure 8A:
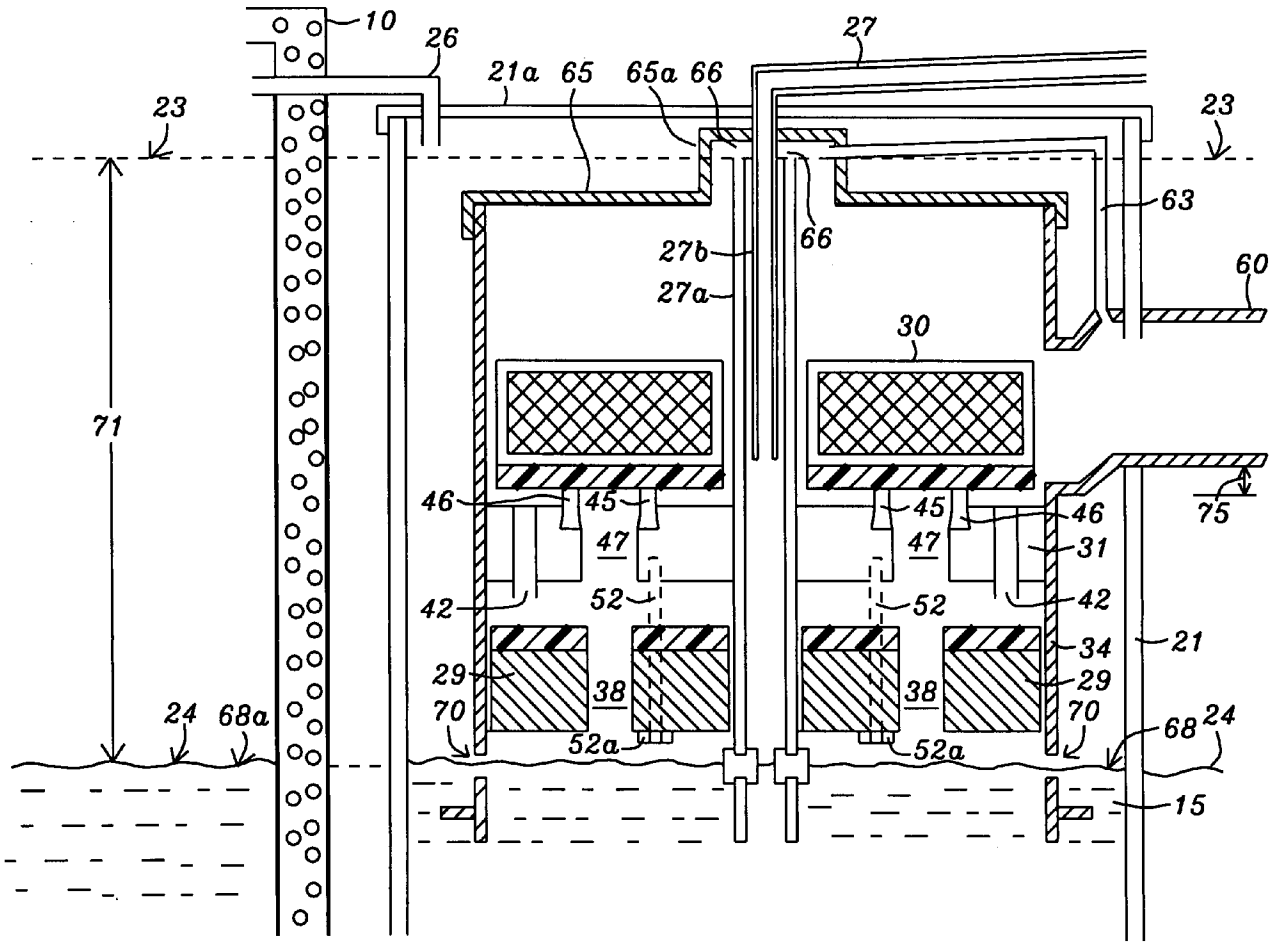
FIGS. 8*a* through 8*e* are cross sections of the float assembly region of the precision siphon unit of this invention showing the position of the floats and the location of effluent within the unit as the effluent level rises within the unit and falls during siphon flow.
Figure 8B:
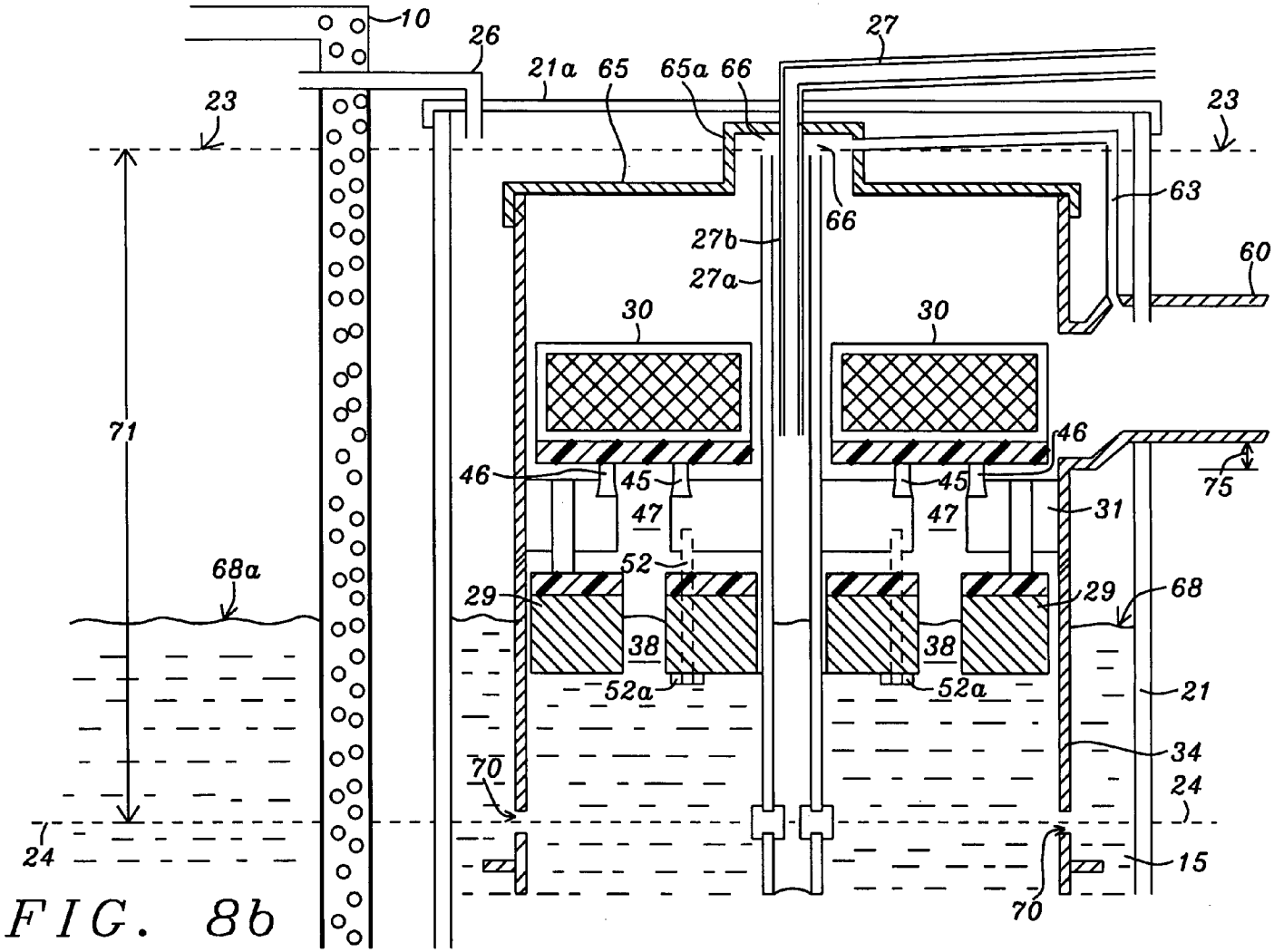
Figure 8C:
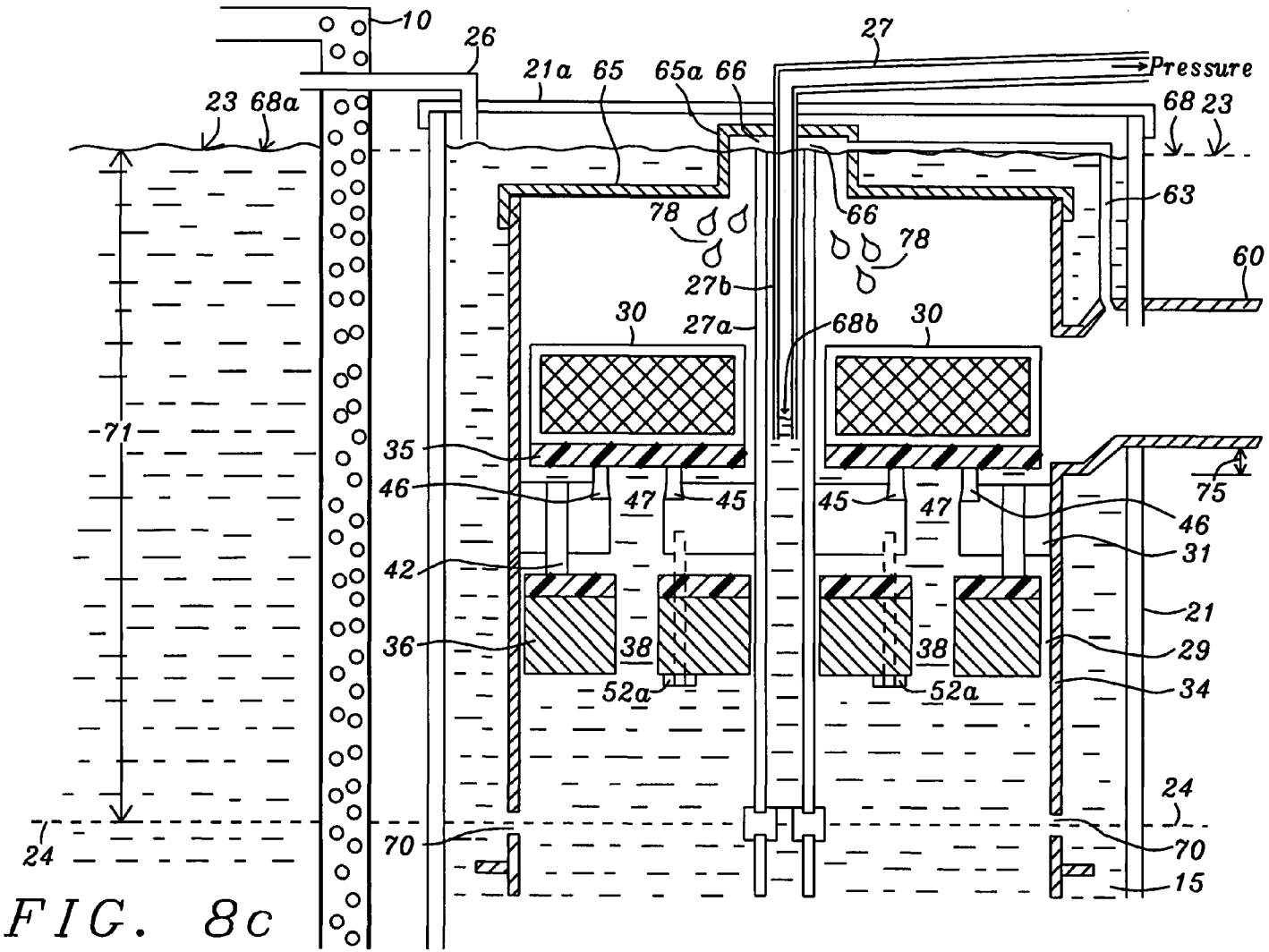

In FIG. 8*a* clear effluent 15 from the septic tank 10 has risen in the unit 20 through the input pipe 22, (see also FIG. 2), passed through the fine mesh screen filter 53*a*, where any residual particles are trapped and reached the level of the openings 70. The liquid level continues to rise in the housing 21 and into the bottom of a cylindrical barrel 34 where it reaches the bottom of a lower float 29. In the absence of liquid, the lower float 29 rests upon wide heads of the orientation retaining bolts 52. Referring to FIG. 8*b*, as the liquid continues to rise, the lower float 29 lifts from the heads of the support bolts 52 and rises to meet the bottom of the drain tubes 42. The elastic layer 40 seals off the drain tubes 42 preventing flow into the region of the barrel 34 surrounding the upper float 30. In FIG. 8*c*, the effluent level has risen further in the region between the barrel 34 and the surrounding housing 21 as well as in the water pipe 27*a* but the sealed drain tubes 42 have kept the effluent from entering the upper region of the barrel above the stationary member 31, thereby keeping the upper float 30 from becoming buoyant.

When the liquid rises above the bottom of the water pipe extension 27*b* the pressure in the air filled water pipe 27 begins to increase because the solenoid valve in the building is closed. This pressure increase is sensed by the pressure switch 97 in the control box 94. The pressure switch is set to trigger the timer 98 to start when the pressure reaches a pre-set value which can be determined either by experiment or by calculation from the overall volume of the water pipe. This value is the pressure reached in the pipe 27 approximately when the effluent level is near the level 23 of the spillover ports 66.

When the level of the effluent finally reaches spillover ports 66 as shown in FIG. 8*c*, the liquid begins to overflow 78 into the upper chamber 64. The elevation 75 in the attached drain pipe 60 prevents the outflow of effluent from the barrel 34 to the drainpipe 60 and allows sufficient accumulation to cause the upper float 30 to become buoyant. Once this occurs the seal between the seating surfaces 45 and 46 and the elastic polymer 35 under the upper float 30 is broken and a sudden rush of effluent passing though the main passages 38 and 47 is released slamming the upper float 30 against the barrel top cover 65 as shown in FIG. 8*d*.

Figure 8D:
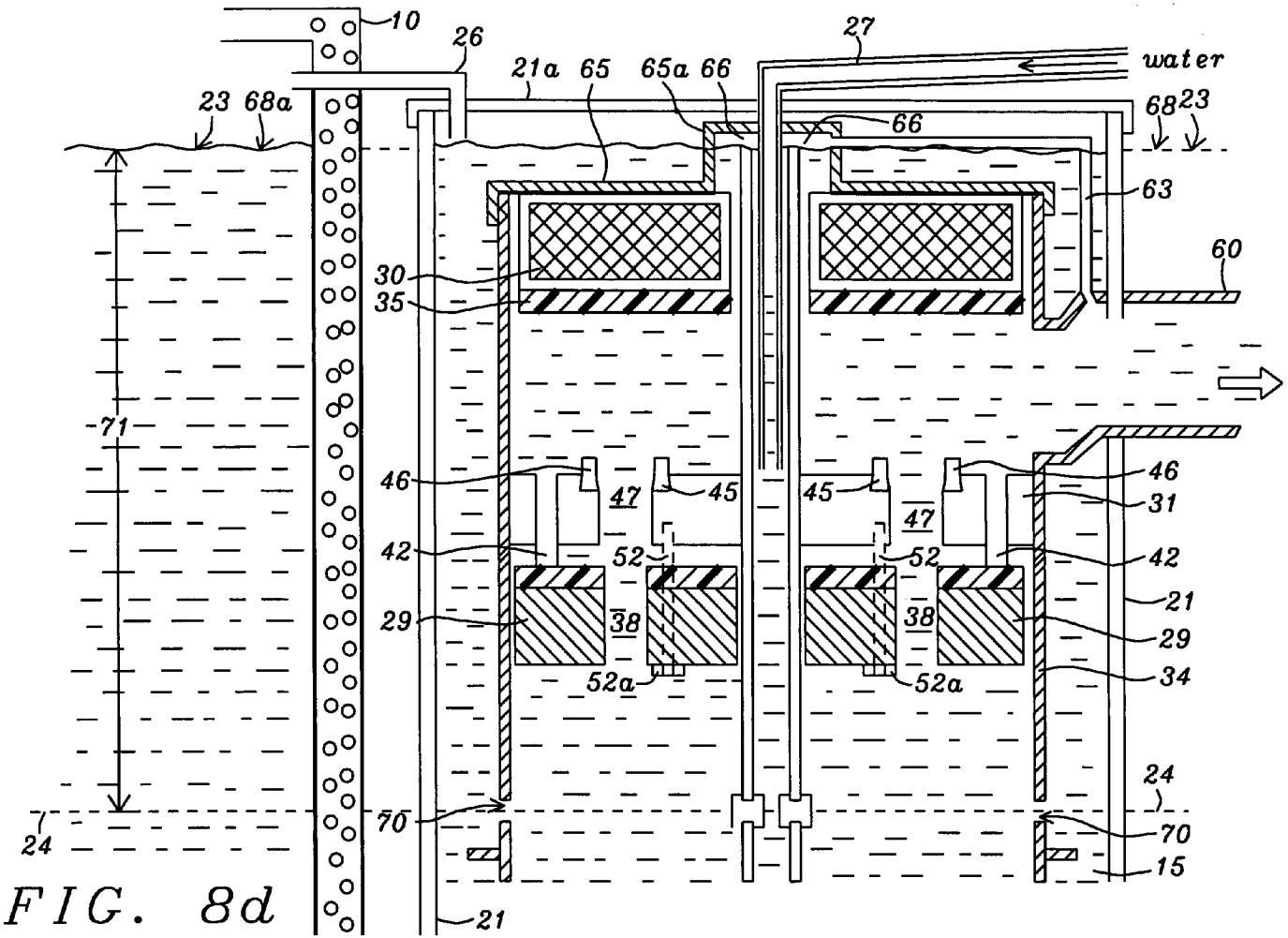

At about the same time, the timer, which has been started by the pressure switch, completes a preset time delay and triggers the solenoid valve 99 to open releasing a burst of water through the water pipe 27 driving any residual air from the upper regions of the chamber 64 and the tube 63 causing the onset of siphon flow indicated by the boxed arrow in FIG. 8*d*. The burst of water is maintained only for approximately a minute or less after which the timer triggers the solenoid valve 99 to close.

Once the siphon begins and the drain pipe 60 is filled, the pan 83 in the distribution box fills and provides an air tight seal to sustain the siphon until the entire dose is delivered, and the level of effluent in the precision siphon unit 20 drops down to the level of the vent holes 70 in the barrel 34, allowing air through the vent pipe 26 on top of the septic tank 10 to enter the flow and break the siphon.

The space at the top of septic tank 10 is connected to the atmosphere via the vents in the plumbing system of the building. This keeps the pressure on top of the liquid layer in the tank always at atmospheric level. If this were not so, then immediately after the start of the siphon, a vacuum would start to develop at the top of liquid in the septic tank 10, and the siphon will cease to operate.

Figure 8E:
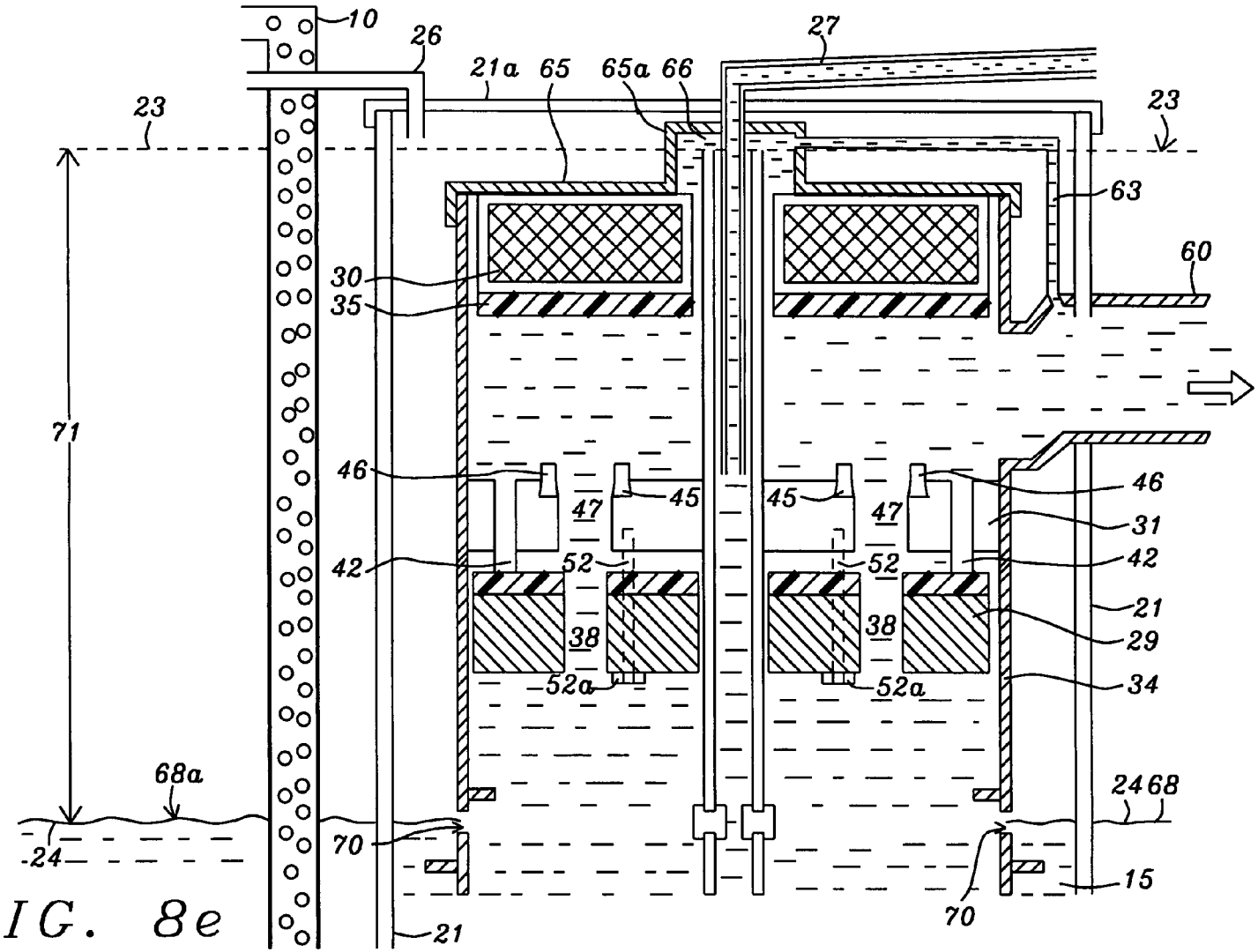

FIG. 8*e* shows the liquid levels 68 and 68*a* in the siphon unit and in the septic tank respectively near the end of the siphon flow. As the liquid level outside of the barrel 34 continues to drop, the openings 70 are eventually exposed, and air rushes into the lower portion of the barrel. The barrel begins to drain, and the siphon is broken. Now the upper float 30 drops down, and seals off the larger passages 38 and 47. The lower float 29 also drops down, and opens the heretofore sealed drain tubes 42 which now permit total drainage of the barrel 34, returning the liquid level in the barrel to the lower limit line 24. Air now fills the space in the barrel 34 and the water pipe 27 all the way up to the solenoid valve 99 in the control box.

After a short delay the timer causes the solenoid valve 99 to open once again at a time when the siphon cycle has reliably been completed. Pressurized domestic water again flows through the water pipe 27 down the central pipe 27*a* of the siphon unit 20 and out the openings 54 of the sprinkler arm 50, which initiates the post siphon backwash of the filter 53*a* within the precision unit. The backwashing is sustained for between 5 and 10 minutes after which the timer closes the solenoid valve 99. The backwashing time is preset in the timer 98 and is determined mainly by the amount of debris collected during the dosing period which depends on the particular application. Typically the back wash period is between about 5 and 10 minutes. Once the backwashing is complete the water now drains out of the pipe 27 and the cycle is complete.

Figure 13:
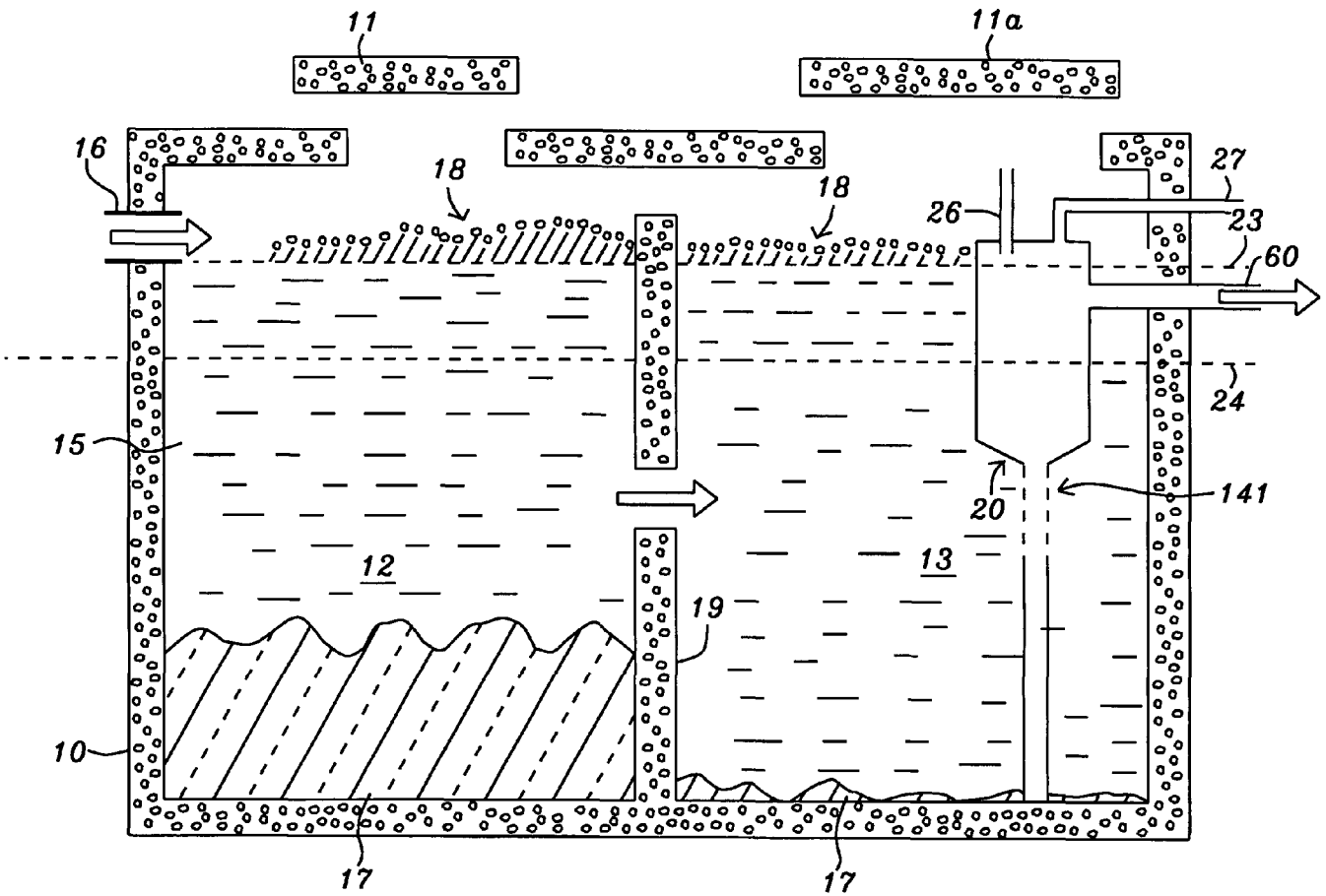
FIG. 13 is a cross sectional diagram showing the installation of the precision siphon unit taught by this invention inside a conventional septic tank.

While in the foregoing embodiment the precision dosing unit 20 was mounted externally on the septic tank 10, it may also be mounted in the septic tank on the wall having the exit port. FIG. 13 illustrates a suitable installation wherein the unit 20 is supported by its inlet pipe 141 which is now perforated at the top to accommodate the incoming liquid and the returning backwash debris. Alternately the unit may be fastened onto the inner wall of the septic tank 10 (not shown). The vent pipe 26 is now already in the tank. The water pipe 27 and the drain pipe 60 are fed in through side openings in the tank. The compartment cover 11*a* provides ready access to the unit. An advantage of this internal mounting is added protection of the unit.

The key component of the present invention, with regard to dosing, is the upper float 30 which, when resting on the sealing surfaces 45, 46, blocks the flow of liquid into the drain pipe as well as into the upper region of the barrel surrounding the upper float while the liquid level elsewhere in the siphon unit and in the septic tank rises to a higher level, thereby building up the dose volume and hydrostatic head beneath the float. The maximum head achieved when the liquid level has risen well above the upper float, is not sufficient to force the float off the seals. However, as liquid begins to come out of the spillover ports 66, and accumulates around the lower half of the upper float, it becomes buoyant, and breaks the seal at 45 and 46. The sudden rush of liquid from below slams the upper float up against the cover. The resulting surge of liquid, supplied by the large volume in the septic tank, quickly forces most of the air out of the drainpipe. Any remaining air in the system is quickly expelled by the entrance of high-pressure water from pipe 27 via the sprinkler jets 54 and the spillover ports 66, and the siphon starts.

The lower float 29 serves only to block the flow of liquid into the upper float region through the drain tubes 42. The drain tubes 42 are needed to drain the liquid remaining in the upper chamber of the barrel after the upper float has dropped back and re-sealed the main flow passages 47 at the end of the siphon cycle.

While the sprinkler backwash assembly plays no role in the dose accumulation and delivery, it is nevertheless a necessary item, which greatly extends the functionality of the fine mesh filter 53*a*; so much so that the filter needs no service even when the septic tank is pumped out and cleaned.

Figure 10:
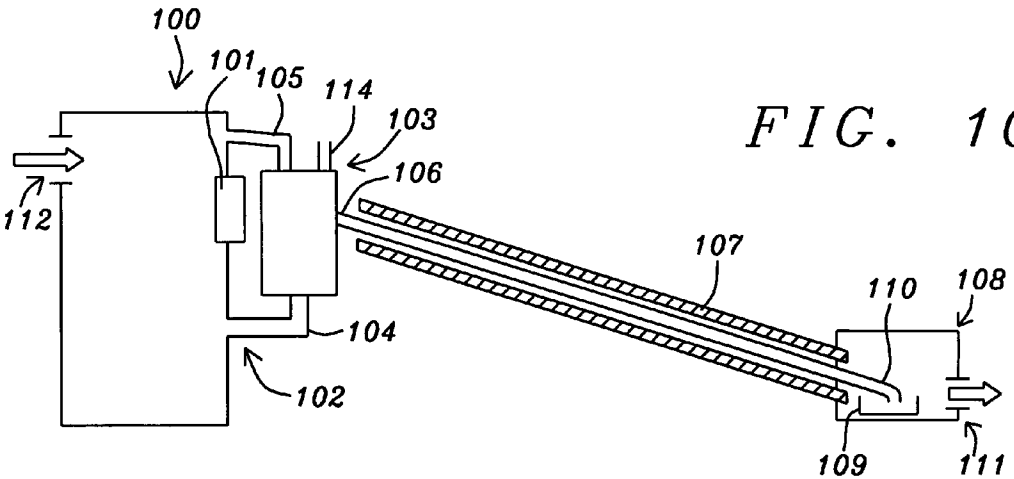
FIG. 10 is a diagram showing a retrofit conversion of an existing conventional septic tank system to the system using the precision siphon dosing system taught by this invention.

Referring now to FIG. 10 there is shown a block diagram, which illustrates how the precision siphon can be retrofitted into an existing conventional gravity fed septic system. The existing septic tank 100 can be either a single or double compartment unit. The conventional exit port of the septic tank is typically too high for use with the precision siphon system and must therefore be plugged 101. A new opening 102 is made below the original and the precision siphon unit 103 described supra is mounted onto the septic tank connecting the inlet pipe 104 to the new opening. The siphon units vent tube 105 is also fitted into a second new opening in the top air region of the septic tank 100. Because the drain pipe required for the precision siphon unit is significantly smaller in diameter (about 2 inches) than the conventional drain pipe (nominally 4 or 5 inches), the new flexible drain pipe 106 is easily inserted within the original drain pipe 107. Depending on the original layout, this may have to be done prior to mounting the new unit 103. The new drainpipe is mechanically protected by the original pipe 107 and may be made of a flexible material or of a polymer such as PVC.

The existing distribution box 108 may also be re-used and outfitted with a pan 109. The end of the drainpipe 106 is fitted with a discharge elbow 110 which is fastened to the pan, having the same relationship to the pan 109 as the corresponding items 87 and 83 in the distribution box 80 supra. The output 111 of the distribution box 108 is left connected to the septic field as is. The input 112 to the septic tank 100 is left undisturbed. Finally a control box and water pipe connection 114 must be made connecting the retrofitted unit to the buildings water and electric supply. This retrofit clearly requires a very minimum (5-10 cubic feet) of excavation and labor making it highly cost effective.

The precision siphon dosing system can be deployed even in those cases where some pitch drop is available, but is insufficient for a simple gravity system, and would normally require the installation of a pump system. If the pitchdrop is enough to maintain a slope of 1 in 200 or even 1 in 300 or 400. The precision siphon dosing can be used as explained below.

If the effluent is cleaned by filtration, as it is in this embodiment, then the customary 1 in 100 pitch is excessive, and there is no justification for it. For comparison the pitch in natural streams or other channels is generally in the range of 1 in 1000, and it still makes the water rapidly flow forward in the downhill direction. Reducing the pitch in half or 1 in 200 or less will still generate sufficient open channel flow velocity to empty the drainpipe quickly after the siphon is broken. It is necessary to empty the drainpipe quickly to prevent freezing of effluent in colder climates.

The precision siphon described by present invention provides the following advantages:

1. It eliminates the need for hazardous and costly electrical service to the septic tanks, thereby eliminating the need for pumps, and other electrical devices in the septic tank.
2. It also eliminates the need for costly, bulky, and separate dosing chambers by effectively using the internal volume of the septic tank, by incorporating into the dose volume the presently unutilized volume represented by the septic tank drop of three inches or more. To make up the entire dose volume it only needs about four inches of the volume below the exit port of the conventional septic tanks. The above-mentioned volume is never available to delay the need for pumping out the sludge from the septic tank, because if the sludge has accumulated to a level to block the passage of liquid through the partition baffle 19 then the system is not functioning and the tank needs to be pumped out anyway.

3. The precision siphon uses the full force of the head provided by the difference in elevation between the bottom of the entrance pipe to the septic tank and the bottom of the distribution box.
4. The precision siphon unit 20 is small enough to fit in a five-gallon bucket.

In a second embodiment of this invention the construction and functioning of an economical and reliable true siphon operated dosing system to prolong the life of septic fields of residential homes or commercial buildings wherein the backwashing of the fine mesh filter is accomplished entirely within the unit without the use of a water pipe or any other support from the building which is serviced by the septic system. The siphon dosing unit is housed entirely within the septic tank and backwashes its filter by return flow of the septic effluent trapped within the unit after the siphon breaks.

Figure 14:
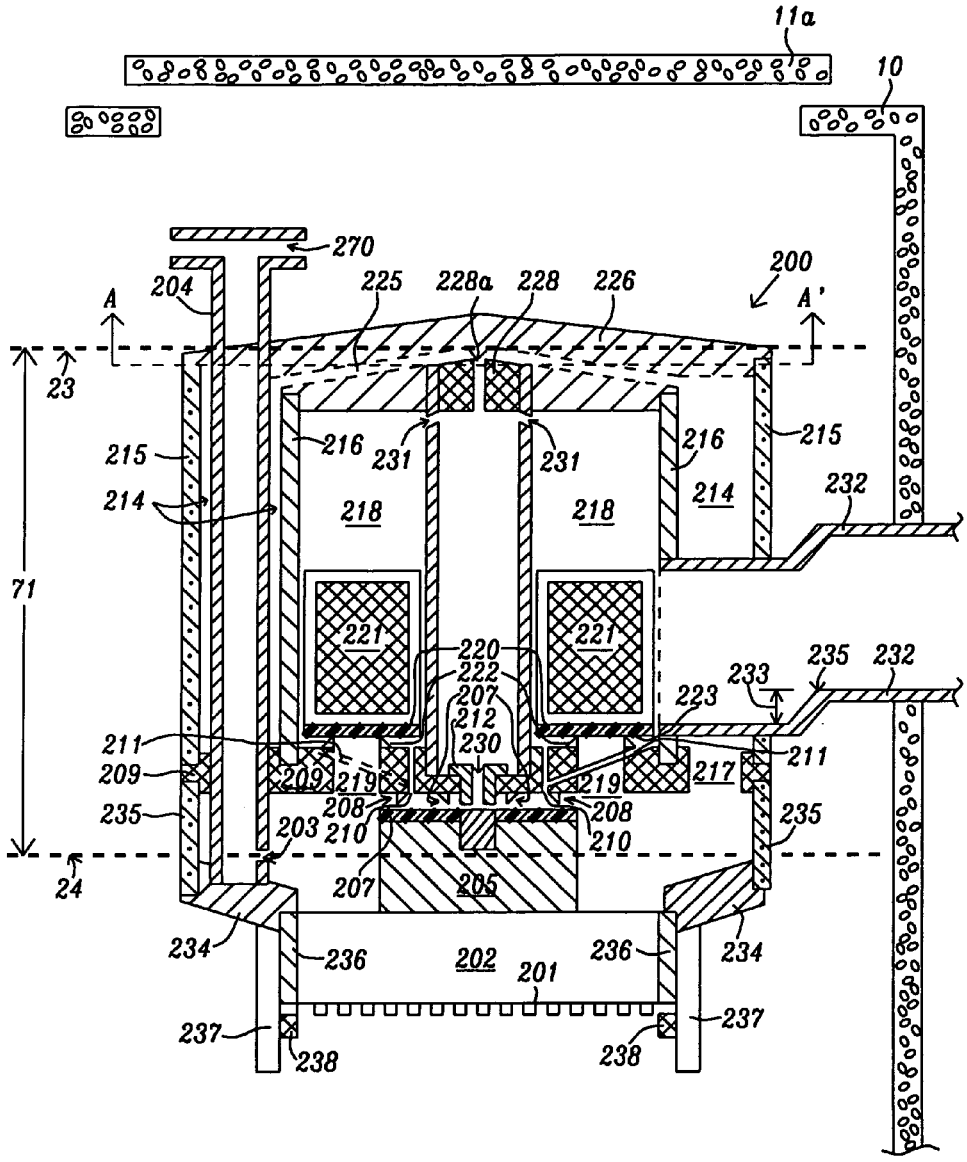
FIG. 14 shows a vertical cross section of the precision siphon-dosing unit taught by a second embodiment of this invention.

Referring to FIG. 14, there is shown a cross section of the siphon dosing unit 200 housed in a conventional septic tank 10 having a cover 11*a*. The outlet pipe 232 of the unit 200 passes through the septic tank wall and to a distribution box configured in the same manner as that of the first embodiment described supra and shown in FIGS. 7*a* and 7*b*. The unit 200 is supported within the tank either by a post structure as shown in FIG. 13 or by the exit pipe 232 itself.

A chamber partition 209 supports both upper 221 and lower 205 floats. The chamber partition is sandwiched between the upper 215 and lower 235 portions of the barrel housing of the dosing unit, providing an airtight connection, and is shown in greater detail in FIGS. 15*a* and 15*b*. The chamber partition 209 controls flow between upper and lower chambers by operation of the floats 205 and 221.

A siphon tube 204, supported on the bottom flange 234, passes vertically through and is sealed, to make the connection airtight, onto the top cover 226 of the unit 200, and extends several inches above the highest liquid level 23 in the septic tank 10, thereby assuring a continuous exposure of the opening of this tube to atmosphere. A tee 270 is included on top of siphon tube to prevent debris from entering the tube. A hole 203 on the side and near the bottom of the siphon tube 204 determines the lowest liquid level 24 in the septic tank 10. As in the first embodiment, the siphon dosing operates between these two levels. The difference between these two levels, as in the first embodiment is referred to as the drawdown 71 of the dosing unit.

A fine mesh filter screen 201 is sandwiched across the bottom input collar 237 of the dosing unit 200 between the inner collar 236 and the locking collar 238. The locking collar 238 may be a snap-ring/O-ring combination permitting easy removal and replacement of the filter 201.

Figure 15A:
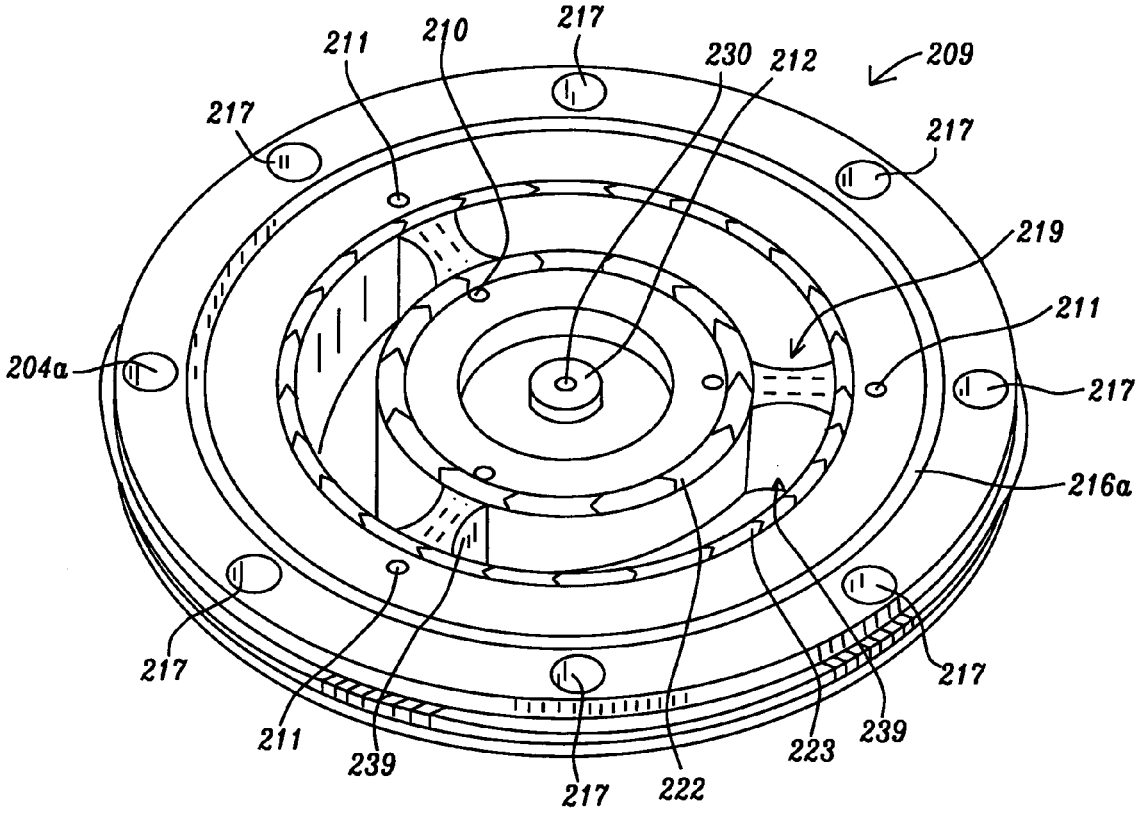
FIG. 15*a* is an isometric view of the chamber partition of the second embodiment of this invention as seen from above.

Referring now also to FIG. 15*a*, the chamber partition 209 is provided with multiple openings 217 which connect the outer chamber 214 (the annular space between the outer cylindrical barrel 215 and the inner cylindrical barrel 216) of the dosing unit with the lower chamber 202, to enable liquid to freely flow between the upper and lower chambers. In the same pattern, opening 204*a* provides a passthrough for the siphon tube 204, while the groove 216*a* receives the bottom of the inner cylindrical barrel which is sealed thereto, separating the inner 218 and outer 214 chambers.

Figure 16:
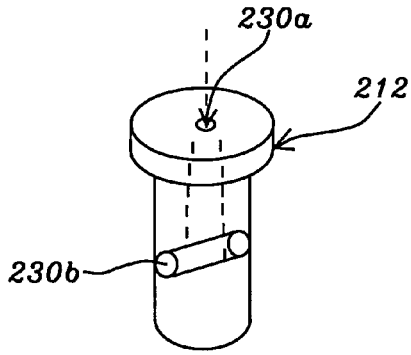
FIG. 16 is an isometric drawing showing details of the retainer stem of the second embodiment of this invention.

The outer drain passages 211 (i.e., outside of upper float seals 223) pass through the three structural webs 239 to connect to the vertical inner drain passages 210, which drain into the space between the lower seals 207 and 208. The lower float 205 is suspended from the center of the chamber partition 203 by a retainer stem 212 which also contains a drain passage 230 to empty the central tube 229 at the end of the siphon cycle. The features of the lower float can be best seen in FIG. 16 where the drain 230 in the retainer stem 212 is illustrated showing a vertical passage 230*a* which connects to a horizontal passage 230*b*. On assembly the retainer stem 212 is glued into the opening in the center of the lower float 205. When assembled, the horizontal passage 230*b* in the retainer stem is just above the top of the sealing gasket 206 as shown in FIG. 14. In operation, when the lower float 205 rises, the gasket 206 engages the inner and outer circular seats 207 and, 208, thereby sealing off the openings from drain passages 210 and 211, as well as the passage 230 in the retainer stem 212, thereby preventing liquid from flowing into the upper chamber 218 as well as into the central tube 229.

Figure 15B:
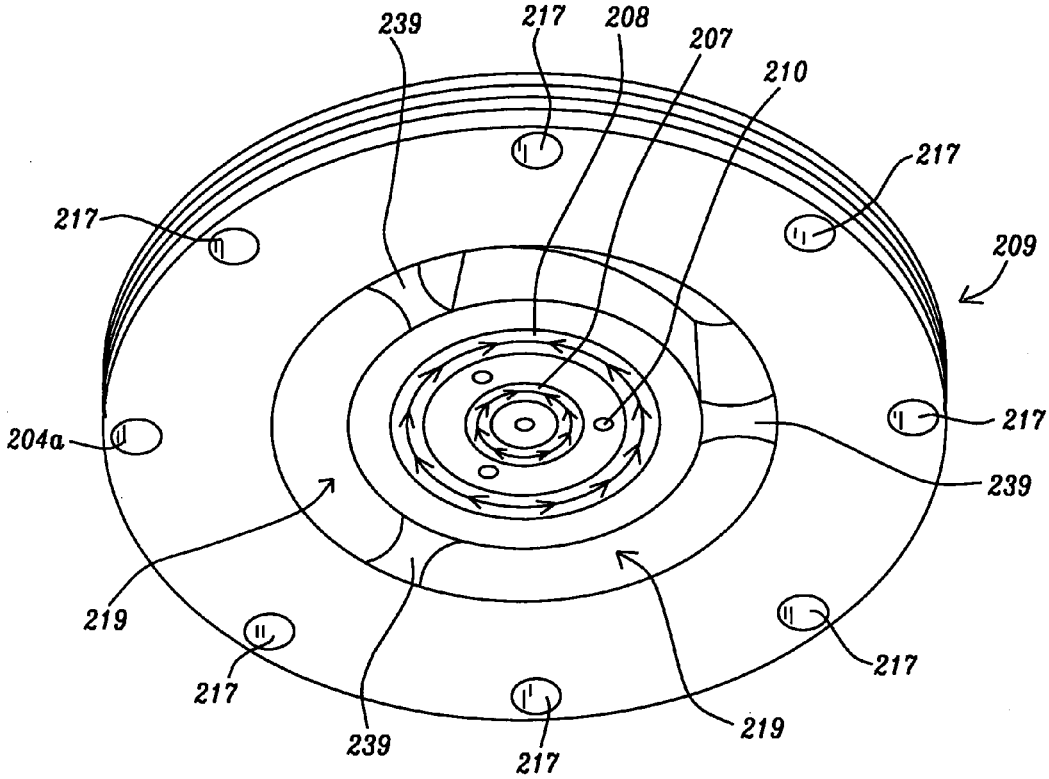
FIG. 15*b* is an isometric view of the chamber partition of the second embodiment of this invention as seen from below.

The circular seats 207 and 208 engaged by the lower float 205 as well as the circular seats 222 and 223 engaged by the upper float gasket 222 are machined on the bottom and top surfaces respectively of the chamber partition 209 which is important in order to obtain a tight seal. FIG. 15*b*, illustrating the underside of the chamber partition 209, shows the lower float sealing surfaces 207 and 208 and the openings 210 of the vertical drain passages.

Figure 17:
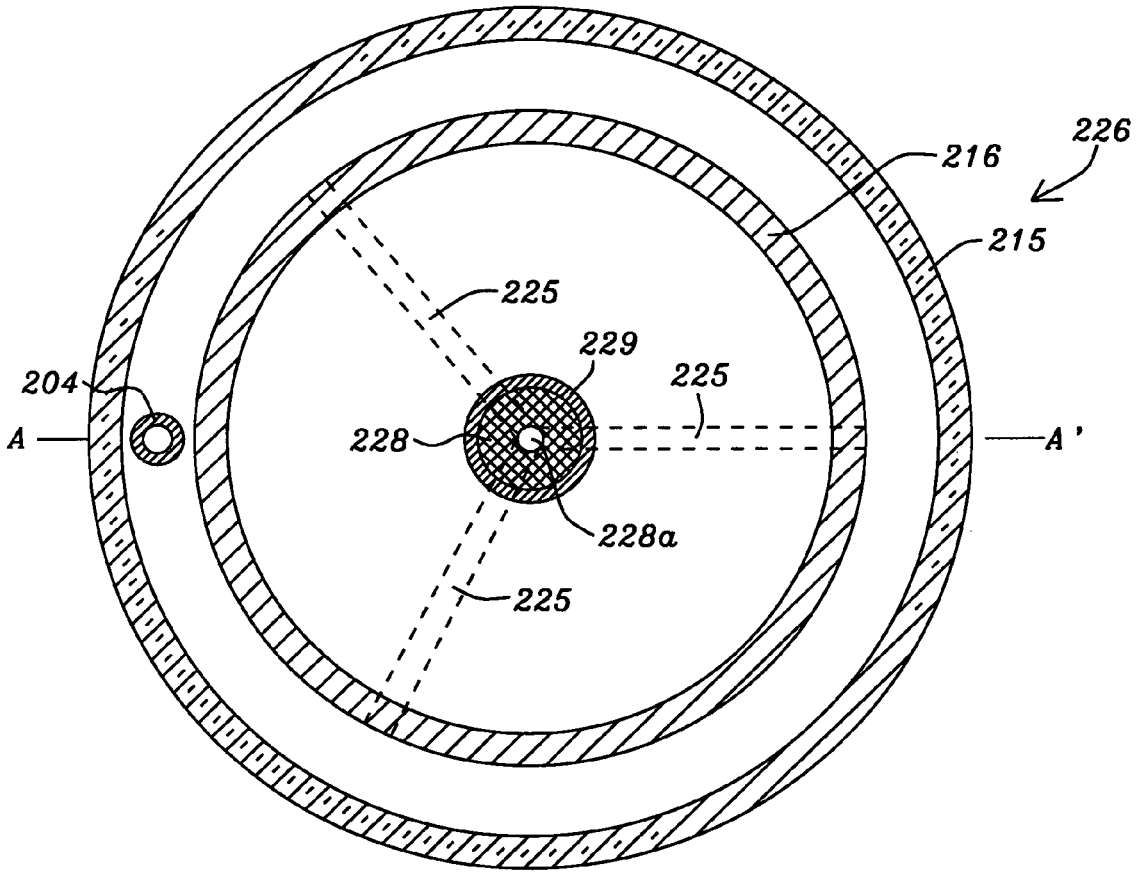
FIG. 17 is a horizontal cross-section of the second embodiment of this invention denoted by the line A-A in FIG. 14 as viewed from above, showing the upper flow passages 225 which extend from the outer chamber 214 through openings in the inner tube 229 into a space over the metering orifice 228.

The top cover of the siphon dosing unit 200 contains the features for filling the upper chamber 218 and starting the siphon flow when the septic fluid level reaches its highest level 23. FIG. 17 illustrates a section of the top cover 226 perpendicular to the line A-A' in FIG. 14. Referring now to FIG. 14 with reference to FIG. 17 there are three passages 225 in the top cover 226 through which septic effluent flows from the outer chamber 214 into the inner tube 229 when the highest level 23 in the septic tank has been reached. The effluent passes through metering orifice 228 located within the top of the inner tube 229. When tube 229 is filled liquid overflows through openings 231 into the inner chamber 218, eventually causing the upper float assembly 221, 220 to become buoyant and starting the siphon flow. This process is similar to that described in the first embodiment and will be detailed for the present embodiment later. The elevated bend 235 in the discharge tube 232 has the same function as in the first embodiment and is designed to permit just the right amount of liquid to accumulate to make the upper float assembly 221,220 buoyant enough to lift, and to start the rapid onset of the siphon flow. The volume of the upper float assembly 221,220 is such that its maximum buoyancy when totally immersed in liquid is about twice its weight. For the upper float assembly 221,220 to become buoyant it is necessary that liquid should accumulate in the space around the lower half of the float and on the outside of seating surfaces 222 and 223. The upper float assembly 221,220 should be immersed in the liquid to a depth, which is near the depth to which the float will sink while freely floating in the liquid. To achieve this accumulation of liquid, a discharge tube uplift 235 is provided.

Figure 18A:
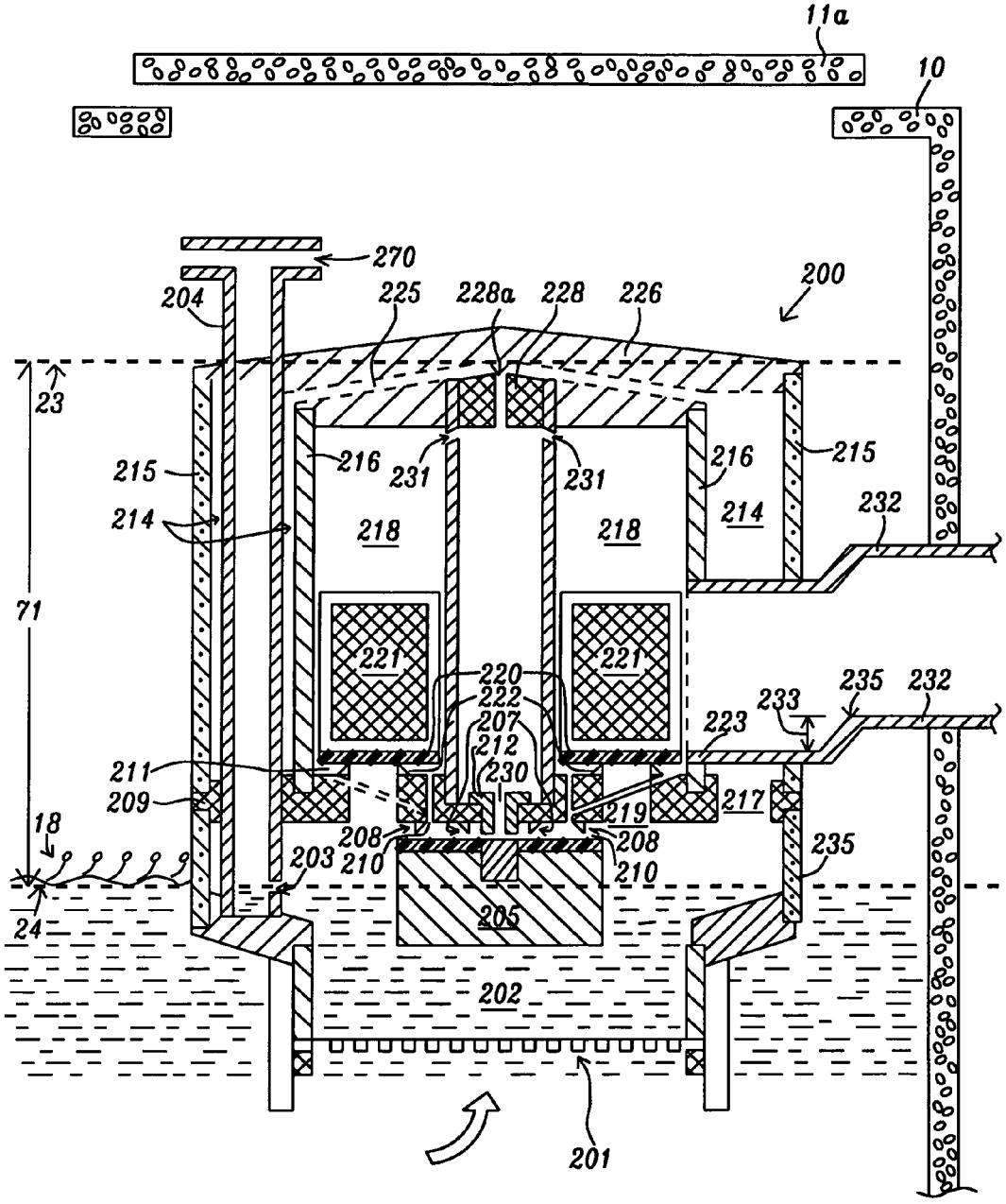
FIG. 18*a* through 18*f* are vertical cross sections of the of the second embodiment of this invention illustrating the operation thereof by showing the position of the floats and the location of effluent within the unit as the effluent level rises within the unit and falls during siphon flow.
Figure 18B:
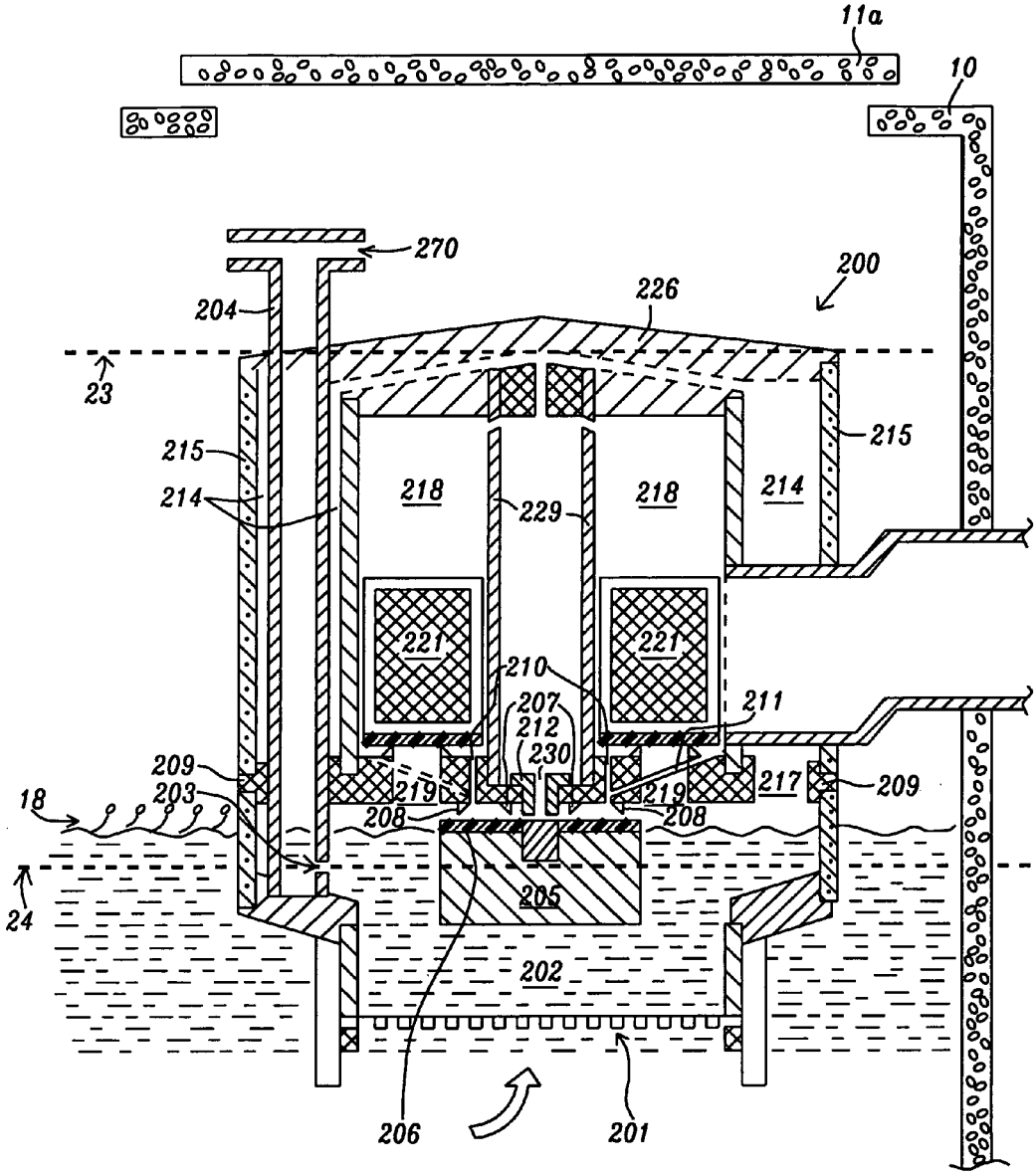

Referring now to FIG. 18*a*, the operational cycle of the second embodiment of this invention will be described. In the figure the septic liquid level is at its lowest 24. The lower float is suspended from the retainer stem 212. As more liquid enters the septic tank 10, the level in the dosing unit 200 rises with liquid flowing through the fine mesh screen filter 201 and into the lower chamber 202. In FIG. 18*b* the level has risen sufficiently to cause the lower float assembly to become buoyant, rising to seal the passages 210 to the upper chamber 218 as well as the passage 230 at the base of the inner tube 229.

Figure 18C:
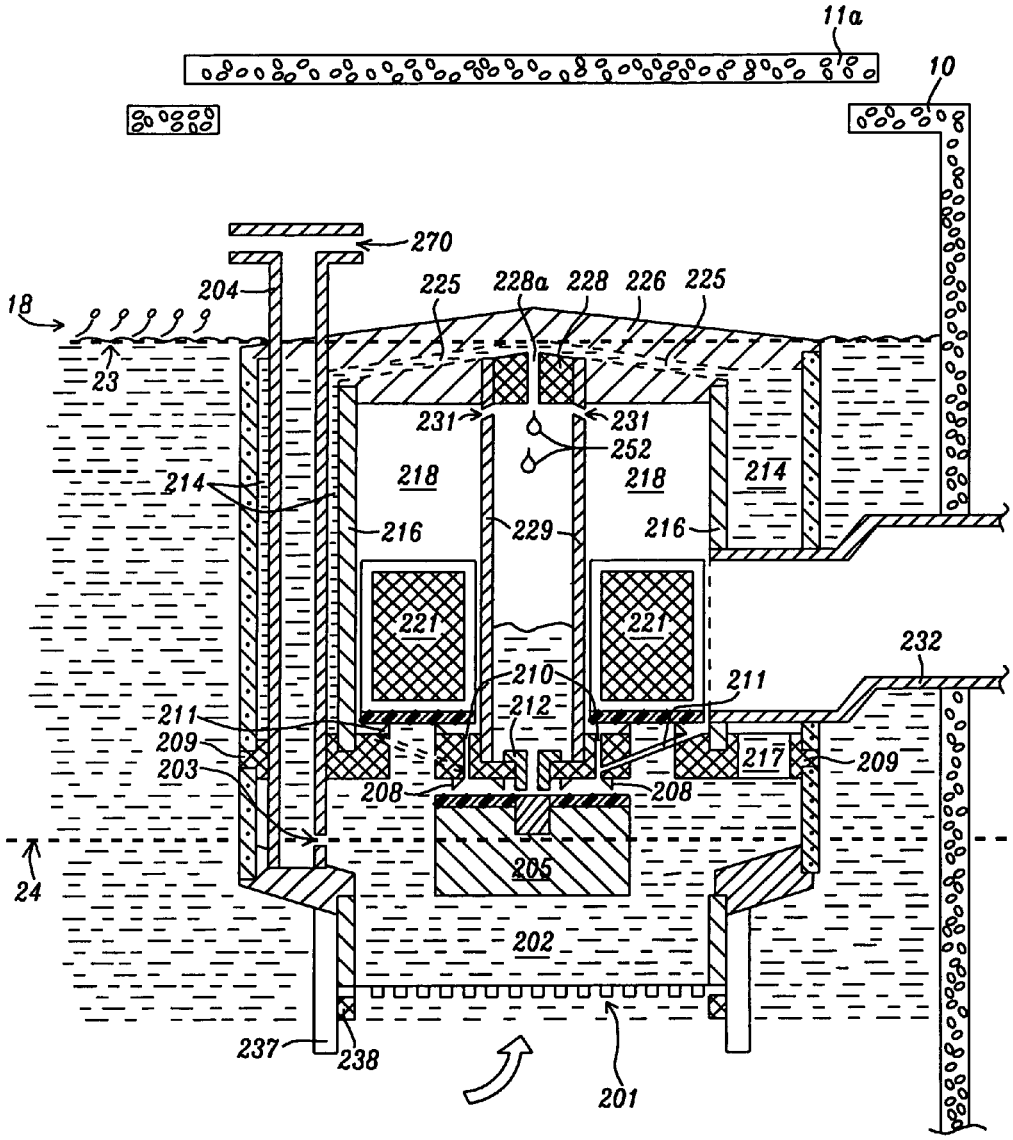

In FIG. 18*c* the liquid continues to rise unobstructed into the siphon tube 204 through siphon port 203, and into the outer chamber 214 through openings 217 in the chamber partition 209. In FIG. 18*c*, when the liquid level has reached the maximum level 23 and begins to flow through the passages 225 in the top cover 226 and down through the opening 228*a* in the metering orifice 228, thereby beginning to fill 252 the inner tube 229 from the top.

Figure 18D:
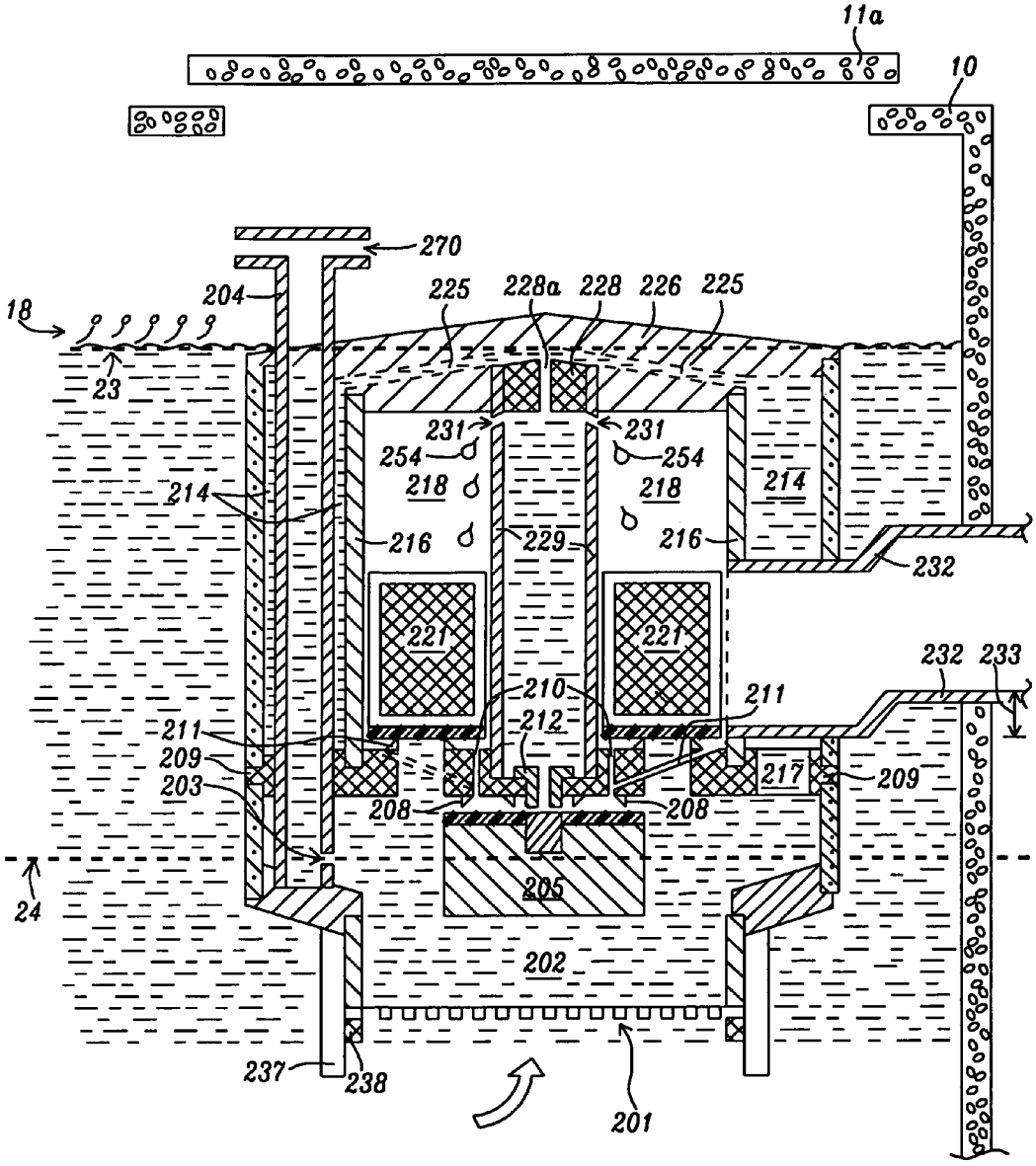

When the liquid level in the inner tube 229 reaches the overflow passages 231 the liquid begins to spill over 254 into the inner chamber 218 as shown in FIG. 18*d*. In the figure, enough liquid has flowed into the inner chamber 218 to bring the level in the discharge tube 232 to near the top of the bend 235, and the upper float 221 is about to break free.

Further rise of the liquid level in the inner chamber 218, but before overflow at the bend 235 occurs, provides enough incremental buoyancy (by design) to lift the upper float 221, when said overflow occurs and raise it to the bottom of top cover 226. The upper float assembly 221 pushes the air in the inner chamber 218 into the discharge tube 232. There is ample clearance between the float 221 and inner wall of the inner barrel 216 and the outer wall of the inner tube 229 to allow the escape of air.

In a very short period (a few seconds) the inner chamber 218 is filled with liquid and the discharge pipe 232 starts filling up. Quickly thereafter all the air in the system is pushed out through the discharge pipe 232 and the discharge pan 83 in the distribution box 80 (see FIG. 7*a*), and the siphon operation begins.

Figure 18E:
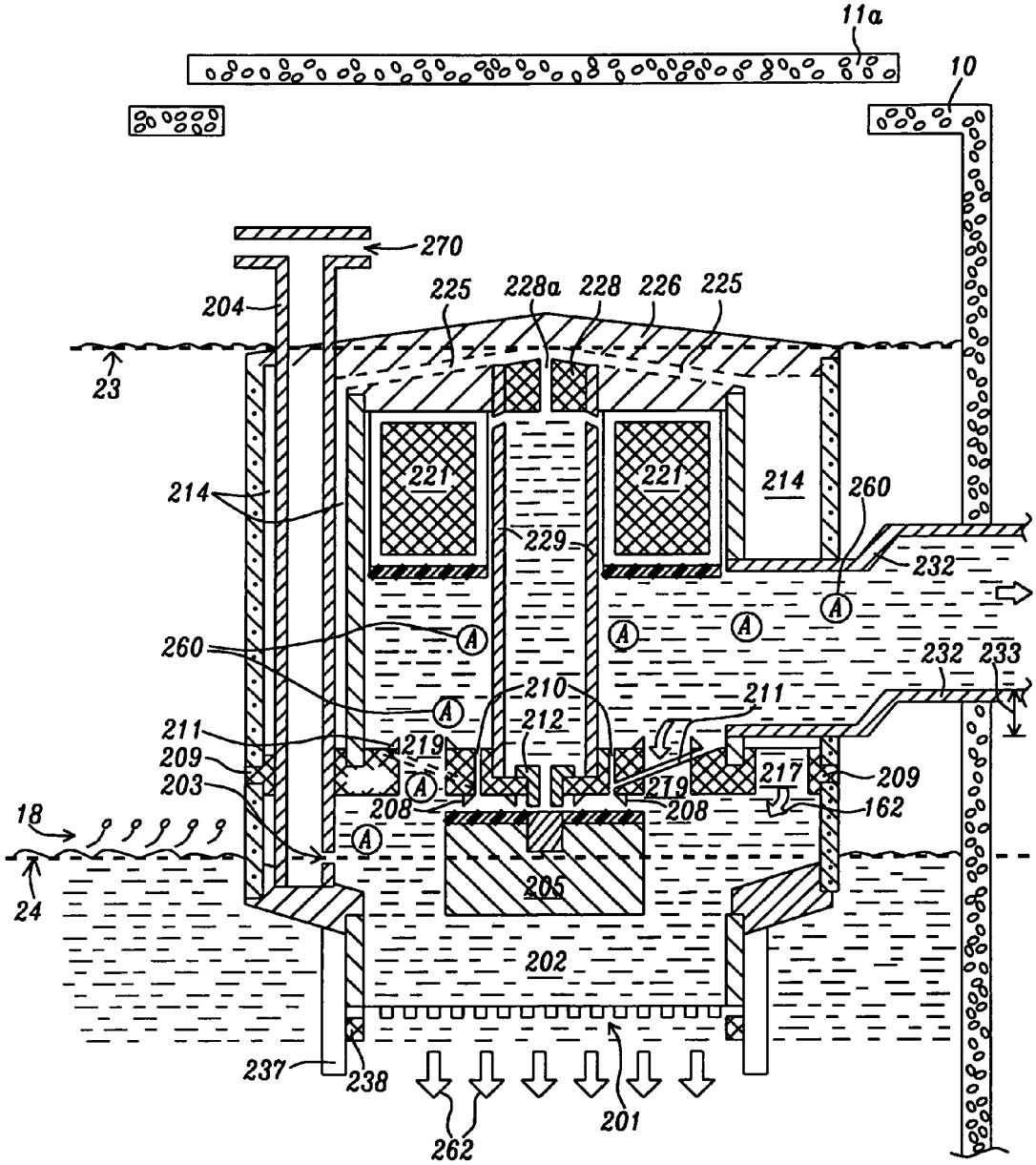

As the siphon proceeds, the liquid level in the septic tank 10, siphon tube 204, and the outer chamber of the dosing unit 200, begins to drop. Referring now to FIG. 18*e*, when the liquid level in the septic tank 10 and in the siphon tube 204 drops to near its lowest level 24, the siphon port 203 becomes exposed to air. Air 260 begins to bubble in and through the annular passages 217 and 219 and starts entering simultaneously into the inner chamber 218 and outer chamber 214, thus breaking the siphon, and causing the trapped liquid to begin to drain downwards. Liquid from the outer and inner chambers flows 262 back into the septic tank 10 through the fine mesh filter 201. This flow backwashes and cleans the filter.

After a few seconds the upper float assembly 221, 220 starts to drop. Liquid trapped in the outer chamber 214 only starts to drop once air bubbles enter the device, and flow through passages 217. Trapped liquid displaced by air in chamber 218 flows down through passages 219.

Figure 18F:
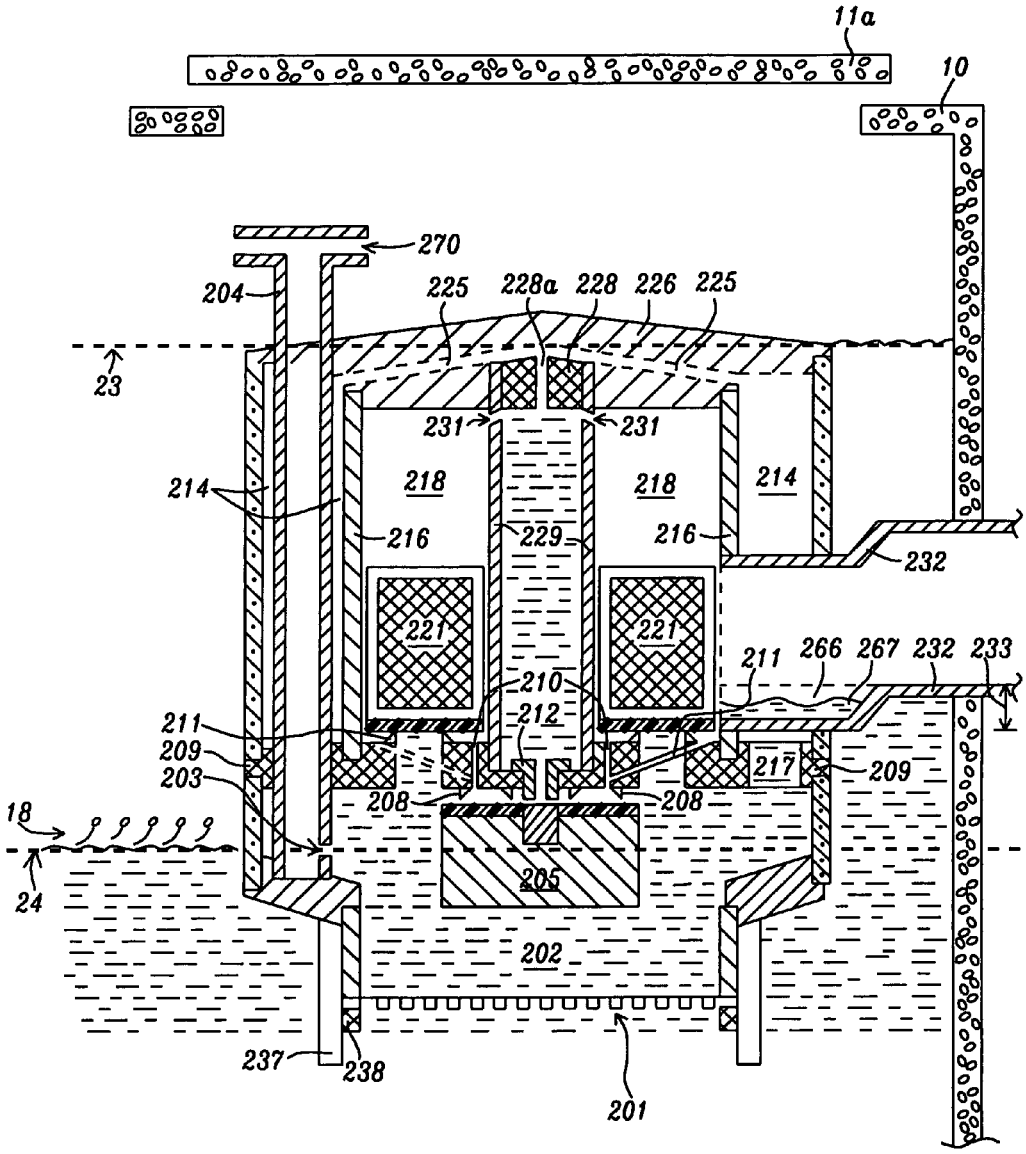
Figure 19:
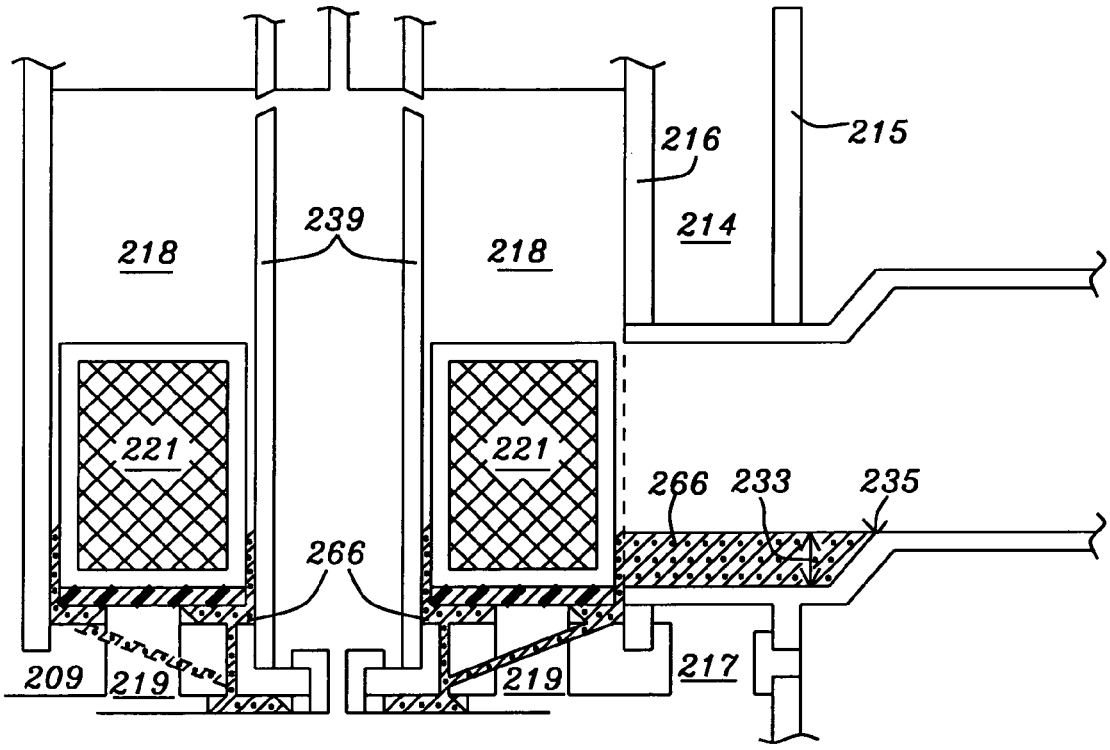
FIG. 19 is a view of a portion of the vertical cross section of the precision siphon-dosing unit taught by a second embodiment of this invention illustrating the clearance volume.

Before the inner chamber 218 is fully emptied, the upper float assembly 221, 220 falls back onto the seals 222 and 223, thereby blocking further flow of liquid from the inner chamber 218 into the lower chamber 202, and leaving residual liquid in a clearance volume 266, as shown in FIG. 18*f*. The clearance volume 266 is illustrated in FIG. 19 and represents the maximum amount of liquid that can remain in the upper chamber after the upper float assembly has dropped. The residual liquid 267 (FIG. 18*f*) in the clearance volume 266 must be removed so that upper float assembly 221, 220 does not rise prematurely during the next siphon cycle.

Liquid continues to flow back into the septic tank to seek equilibrium. Eventually the lower float 205 drops to its suspended position, releasing the seals against the drain passages 210/211 and thereby allowing the residual liquid in the clearance volume 266, as well as liquid in the inner tube 229, to drain back into the lower chamber, through passages 210/211 and through discharge tube 232, respectively. At the same time the inner tube drains through the passage 230 in the stem retainer 212 completing the filter backwash and returning the liquid level in the dosing unit to the initial condition shown in FIG. 18*a*. When all the liquid above the lowest liquid level 24 has drained back the siphon cycle is completed, and the unit is ready for the next cycle.

While this invention has been particularly shown and described with reference to the preferred embodiments thereof, it will be understood by those skilled in the art that various changes in form and details may be made without departing from the spirit, principles, and scope of the invention.

What is claimed is:

1. A siphon dosing system comprising:

(a) an upper barrel sealed at the base to a circular chamber partition and having a cover defining an upper chamber therein, said chamber partition having at least one flow passage and a plurality of upper chamber drain passages extending vertically therethrough to drain said upper chamber;

(b) an upper float in said upper chamber which, at rest, seals said at least one flow passage;

(c) a lower float beneath said chamber partition and suspended centrally therefrom by a retainer stem, said retainer stem having a shaft which slides vertically within an opening in the center of said chamber partition but is prevented from dropping through by an upper lip thereon;

(d) wherein said lower float, when buoyant, rises to seal said plurality of upper chamber drain passages, thereby blocking liquid flow into said upper chamber from below;

(e) a vertical central tube sealed at its base centrally onto said chamber partition, surrounding the top of but not impairing the movement of, said retainer stem, said central tube extending upwards and sealed into said cover;

(f) at least one spillover port in said central tube directly beneath the juncture of said central tube with said cover;

(g) a metering orifice in said central tube above said at least one spillover port;

(h) at least one radial passage within said cover passing from the top of an outer chamber to an opening above said metering orifice;

(i) a cylindrical exterior housing concentric with and external to said barrel, sealed to said the outer perimeter of said chamber partition which extends outwardly beyond the base of said barrel, extending upwardly sealing to said cover, thereby defining said outer chamber above the chamber partition, and extending downwardly beneath said chamber partition, terminating at a diameter reducing flange;

(j) an inlet conduit comprising tube sealed to said diameter reducing flange and embracing a fine mesh filter mounted thereon and thereby defining a lower chamber between said chamber partition and said fine mesh filter;

(k) a siphon tube within said outer chamber, sealed onto said lower reducing flange and extending upward, through said chamber partition, through said cover, sealed thereto, and extending above said cover, terminating open to atmosphere above the cover, said siphon tube further having an opening near its base to allows air to flow into the lower chamber when said siphon tube is drained therebelow;

(l) a plurality of flow passages between said outer chamber and said lower chamber through said chamber partition; and (m) an exit pipe with an initial uplift passing from said upper chamber, through said exterior housing, directed through a discharge elbow, into a discharge pan in a distribution box.

2. The dosing system of claim 1 wherein said upper float, said lower float, and said upper barrel are made of a durable polymer, polyvinyl chloride, or a non corroding material.

3. The dosing system of claim 1 wherein said upper float seals said at least one flow passage and said lower float seals said drain passages with elastic gasket layers comprising a soft durable rubber or synthetic polymer bonded respectively onto the underside of said upper float and onto the topside of said lower float.

4. The dosing system of claim 1 wherein the height of the initial uplift is greater than the minimum height of the liquid required for the upper float to become buoyant.

5. The dosing system of claim 1 wherein the end of said discharge elbow extends into said discharge pan and is spaced above the bottom of said discharge pan by a distance of about one fourth the inside diameter of the open end of the discharge elbow.

6. The dosing system of claim 1 wherein the net flow area of the fine mesh filter is greater than the flow area of the exit pipe.

7. The dosing system of claim 1 wherein the said retainer stem has a drain passage comprising a central vertical portion extending from the top of the stem to a corresponding horizontal portion which exits the retainer stem beneath said chamber partition and above said lower float.

8. A siphon dosing system comprising:

(a) a stationary member sealed to the inside of a barrel having a cover defining an upper chamber therein and having at least one flow passage and a plurality of drain passages extending vertically therethrough;

(b) an upper float in said upper chamber which, at rest, seals said at least one flow passage;

(c) a lower float beneath said stationary member having flow passages corresponding to said at least one flow passage and which, when afloat, rises to seal said drain passages, thereby blocking flow into said upper chamber from below;

(d) A central pipe passing through and sealed to said stationary member and extending upwards into a dome in said cover;

(e) at least one spillover port in said central pipe within said dome;

(f) an exterior housing enclosing said barrel and having a bottom inlet conduit for receiving liquid from a septic tank; and (g) an exit pipe with an initial uplift passing from said upper chamber, through said exterior housing, and a discharge elbow, into a discharge pan in a distribution box.

9. The dosing system of claim 8 wherein the volume of the upper float is such that its maximum buoyancy when totally immersed in liquid is about twice the combined weight of the upper float and a gasket layer bonded thereto.

10. The dosing system of claim 8 wherein the height of the initial uplift is greater than the minimum height of the liquid required for the upper float to become buoyant.

11. The dosing system of claim 8 wherein the end of said discharge elbow extends into said discharge pan and is spaced above the bottom of said discharge pan by a distance of about one fourth the inside diameter of the open end of the discharge elbow.

12. The dosing system of claim 8 wherein the net flow area of the fine mesh filter is substantially greater than the flow area of the exit pipe.

* * * * *